US007549762B2

(12) United States Patent
Dinnerstein et al.

(10) Patent No.: US 7,549,762 B2
(45) Date of Patent: Jun. 23, 2009

(54) DEVICE FOR ILLUMINATING READING MATERIAL

(75) Inventors: Gillian M. Dinnerstein, 400 Alton Rd., Apt. 1803, Miami Beach, FL (US) 33139; Peter Millward, Marlow Bucks (GB)

(73) Assignee: Gillian M. Dinnerstein, Miami, FL (US)

( * ) Notice: Subject to any disclaimer, the term of this patent is extended or adjusted under 35 U.S.C. 154(b) by 0 days.

(21) Appl. No.: 11/924,260

(22) Filed: Oct. 25, 2007

(65) Prior Publication Data

US 2008/0101055 A1 May 1, 2008

Related U.S. Application Data

(60) Provisional application No. 60/863,083, filed on Oct. 26, 2006.

(51) Int. Cl.
*F21V 33/00* (2006.01)

(52) U.S. Cl. ..... 362/99; 362/98; 362/253; 362/183

(58) Field of Classification Search ..... 362/253, 362/98, 99, 156, 154, 234, 183; 281/29, 281/51, 45, 46, 49, 15.1
See application file for complete search history.

(56) References Cited

U.S. PATENT DOCUMENTS

| | | | |
|---|---|---|---|
| 1,673,595 | A | 6/1928 | Scoggins |
| 2,806,715 | A | 9/1957 | Smith |
| 3,885,145 | A | 5/1975 | Wise |
| 4,266,164 | A | 5/1981 | Schroeder |
| 4,290,093 | A | 9/1981 | Thompson et al. |
| 5,610,770 | A | 3/1997 | Galiani |
| 5,639,156 | A | 6/1997 | Broxson |
| 5,697,572 | A | 12/1997 | Salentine et al. |
| 5,699,039 | A | 12/1997 | Korzen |
| 5,813,748 | A | 9/1998 | Maxymych |
| 6,302,563 | B1 | 10/2001 | Yama |
| 6,409,357 | B1 | 6/2002 | Thompson et al. |
| 6,637,907 | B1 | 10/2003 | Levy |
| 6,666,563 | B2 | 12/2003 | Brown |
| 6,736,531 | B2 | 5/2004 | Wallach |
| 6,764,192 | B2 | 7/2004 | McChesney |
| 6,796,673 | B1 | 9/2004 | Dempsey et al. |
| 7,128,433 | B2 | 10/2006 | Schlosser |

(Continued)

*Primary Examiner*—Laura Tso
(74) *Attorney, Agent, or Firm*—Laurence A. Greenberg; Werner H. Stemer; Ralph E. Locher

(57) ABSTRACT

A device for illuminating single or multiple page reading material in dimly lit locations, includes two hinged-together cover panels each having a holder for the reading material. The panels completely enclose the reading material in a closed condition and permit reading of the material in an open condition. An additional panel is hinged to one of the cover panels and a wireless or rechargeable lighting module with a programmable microprocessor is retained to the additional panel for moveably directing light onto the reading material. One panel may be used with a flexible strap connected to the panel and retaining the lighting module. A lanyard may be used to connect the panel to the lighting module. The panel may have a cavity and a reel on which the lanyard is wound and connected to the lighting module. The panel may have a channel for a flexible strap retaining the lighting module.

18 Claims, 19 Drawing Sheets

U.S. PATENT DOCUMENTS 7,163,307 B1 1/2007 Clark et al.
2003/0012013 A1 1/2003 Herrera
2003/0086256 A1* 5/2003 Ip ..... 362/98

* cited by examiner

DEVICE FOR ILLUMINATING READING MATERIAL

CROSS-REFERENCE TO RELATED APPLICATION

This application claims the priority, under 35 U.S.C. § 119(e), of U.S. Provisional Patent Application No. 60/863,083, filed Oct. 26, 2006; the prior application is herewith incorporated by reference in its entirety.

BACKGROUND OF THE INVENTION

1. Field of the Invention

The invention relates to a device for illuminating reading material, such as a menu or a book, for ease of viewing in dimly lit restaurants or other locations where they might be difficult to read.

2. Description of the Related Art

It is often necessary to read materials such as menus in low lighting areas, such as restaurants, bars, nightclubs, etc. as well as in areas in which natural light or artificial light may be obstructed. More expensive restaurants, taverns, theaters and adult entertainment venues often are purposely dimly lit. This is true for bars and taverns as well. That makes it difficult to read the menu, especially for those who do not have perfect eyesight or have forgotten to bring their eyeglasses with them. Similarly, mechanics may have difficulty in reading a repair manual while working under the frame or under the hood of an automobile and passengers may have difficulty reading a map when traveling at night.

In the past, waiters in a restaurant have offered a patron a candle, which provides limited light and is dangerous to use. The use of a flashlight disturbs the ambiance and possibly other patrons in an expensive restaurant. Pen lights are constantly disappearing or being dropped and damaged and wait staff must spend time handing them out with menus. Mechanics have used flashlights or utility lights, but they are clumsy and awkward and when laid down are difficult to find since they are unattached, separate units. Automobiles and airplanes may or may not have a map light and even if they do, it is not always a flexible light able to be angled to necessary areas.

U.S. Pat. No. 1,673,595 discloses a menu holder with a light fixed in place at the top and an on/off switch. U.S. Pat. No. 2,806,715 is a note pad holder with a light fixed in place at the top as well. Similarly, U.S. Pat. No. 3,885,145 has a light fixed in place to a side of a panel. U.S. Pat. Nos. 4,266,164, 6,302,563 and 5,813,748 teach an electroluminescent panel from which light shines through paper placed on the panel. The devices can only be used on paper of a limited thickness and cannot be used on more than one page, since the light will illuminate the text on pages between the light and the top page, rendering the reading matter illegible. Those devices are also inappropriate for reading material which is printed on both sides of the page or where two pages are inserted in a clear plastic leaf as an alternative to double-sided printing. U.S. Pat. No. 5,699,039 shows a menu stand having a light source and a call signal for a waiter. U.S. Pat. No. 6,796,673 is a check presenter with a signal beacon. All of those devices provide a single flat panel for holding and illuminating or magnifying reading material form a fixed source. Such a lighting device is an integral part of the menu cover and therefore must be recharged in a special area or installation, taking up valuable space.

U.S. Pat. No. 5,610,770 discloses a magnifying container or stand for printed matter having a single panel or booklet construction. U.S. Pat. No. 6,637,907 discloses a device for illuminating a menu, having LEDs in a frame illuminating the menu from the sides when the frame is held by a user. The device may have two panels as well. U.S. Pat. No. 6,409,357 teaches an illuminated billfold or portfolio having a light at the top of one flat panel and another flat panel having a cutout for the light when the billfold is closed. A contact switch activates the light when the billfold is opened. U.S. Pat. No. 5,639,156 teaches a flat, two-panel holder for reading material having illumination sources fixed to the top of the holder. Although those devices may have two panels, the sources of illumination which are present are fixed to a panel and may not reach all areas of the pages.

U.S. Pat. No. 6,764,192 has a pivoting magnifier and a light at a pivot point of the magnifier. Although the magnifier and light can swing out, the light is not freely moveable and would not permit two panels to close over it.

U.S. Pat. No. 4,290,093 shows a case having a base for receiving a magazine and a cover hinged to the base. The cover has an illuminating device opposite the hinge and is the same size as the base. The illuminating device is fixed to the cover and not on an additional panel. Similarly, U.S. Pat. No. 7,163,307 has a light on a panel which is the same size as a panel holding a check. U.S. Pat. No. 3,885,145 also has a light fixed on a side of a panel holding reading material. The reading material is opened and closed at the spine to reduce glare and prevent light from shining in the reader's eyes, but no adjustment for the pages on the panel fixed to the light is possible.

U.S. Pat. No. 7,128,433 has a backlight for shining through paper, a magnifying sheet and another light on an additional panel of the same size as the backlight panel, for shining through the magnifying sheet.

Attempts to solve the above-mentioned problems have been addressed in the prior art, but those attempts have not taken into account restaurant and bar industry restrictions, leading to bulky, single-page, expensive and time and space-consuming configurations which must be charged while inside the menu cover, requiring special individual storage space.

None of the prior art devices permit a user to freely select which portions of the reading material are to be illuminated by manipulating a panel or lighting module which is smaller than and separate from the panel or panels used for covering, uncovering and holding the reading material. The devices are thus cumbersome, difficult to use and unsightly and therefore not acceptable for all applications.

SUMMARY OF THE INVENTION

It is accordingly an object of the invention to provide a device for illuminating reading material, which overcomes the hereinafore-mentioned disadvantages of the heretofore-known devices of this general type, which permits a user to freely select portions of reading material to be illuminated by manipulating a panel or lighting module that is smaller than and separate from the panel or panels used for covering, uncovering and holding the reading material, and which is not cumbersome, is easy to use, requires no special or additional storage space or charging area and is acceptable for all applications.

The invention should address the most important issues at hand:

The device should require very little additional or specialized space for storage or recharging in an industry where space is prime.

The device should be easy to maintain and use by both a proprietor and a customer.

The device should be cost effective.

The device should preferably be in the form of a holder for a menu, a wine list, a check presenter, a theater program, a brochure, a book or a manual. The device should be easy to use, compact, attractive, require no special storage space, be socially acceptable in all areas and optionally automatically activated during use. A further option is that of a magnification attachment.

In restaurants, for example, the device should present little or no inconvenience to the proprietor of the establishment and the cost should be minimal. The device will expand the patron's knowledge of wine and food selections, potentially leading to greater and more varied selections. The device will permit a proprietor to offer an additional, much needed service to a patron for a one-time, nominal cost for a device which is easy to use and simple and economical to maintain.

The fact that the illumination comes from inside the menu cover means that the light source will not need to be as powerful as a normal flashlight and will ensure that the ambiance of the restaurant is not compromised. The patron with poor vision will not feel any embarrassment in using the assistance of the device, since all menus in the restaurant would be uniform.

The feature of the light being part of the menu cover will prevent the proprietor from constantly replacing the visual aid or parts thereof, i.e. batteries, such as when using a pen light, resulting in long-term cost reduction for components and staff time. Multi-point, rechargeable equipment which should need recharging only about once a week, but could last as long as a month based on available units and recommended rotation, should be used. This would eliminate the high cost and lost hours for replacement batteries, although the device may be optionally offered with disposable battery power, if the user of the device chooses. The devices can be stacked upon any shelf close to any electrical outlet. Each multi-point recharging unit can house many cassettes or in the case of charging pins, as many as is convenient for the staff to handle without tangling. The charging pin wire could be retractable, coiled or housed on a reel to alleviate such potential tangling. The number of menu covers which can be charged at one time from a single electrical outlet can be limitless, due to the minimal amount of energy required to recharge each unit.

The product can be integral to any existing structure, and can be made from almost any material from which current menu holders or wine lists are made. The housing can be embossed with advertising, for additional product awareness and potential additional revenue for the establishments or wine/food suppliers.

The unit may be assembled from five or six components. The first is a printed circuit board which will house components of an LED light source, such as a light head or panel, a rechargeable battery or battery pack, and a switch which can be depressed in order to illuminate the LED and which when released shuts off the light and conserves battery power. A recharging socket, and possibly a retractable, spring-loaded cord housing, which will attach at the other end to an item to be illuminated, are to be provided. Circuit control software on a programmable microprocessor or chip may be implemented to determine whether the light is timed and/or determined by the push button control. The charge control software secures safety issues and prolongs the "life" of the battery. These components will then be contained in a molded housing which may be customized to match the establishment's menu or wine list and may have various shapes described below, including, but not limited to, an oval for comfort, a rectangle for a third hinged panel, or novelty shapes such as that of a wine or beverage bottle or glass, a female form or other customized shapes.

The Battery options are as follows, noting that the choice of the battery type to be used will be dictated by economic and size requirements. Lithium polymer batteries have a capacity of 170 mAhr and a compact size of 36 mm×22 mm3 mm and most efficient lithium ion batteries are also compact and efficient batteries, but are also the most expensive. Their capacity is 140 mAhr (milliampere hours) and their output is 3.7 volts. This provides a continuous on-time of nearly three hours when a current of 50 mA flows through the LED. These batteries have special charging and protection features built into the battery and do not need to be fully depleted prior to recharging. The size is a compact 20 mm×25 mm with only 4 mm in thickness, making them the first choice for this device. The other option is nickel metal hydride (NIMH). Each cell is 1.2 volts so that three cells connected in series are needed to provide the 3 volts required to power white LED bulbs. The LEDs need a voltage of 3 volts for operation and conduct a current through them which is controlled by a series resistor. Their capacity is 80 mAh, about one-third of the lithium polymer and one-half of the lithium ion batteries, although adequate for the needs of this device. 80 mAh will provide continuous light for about or 1.6 hours before needing recharging. Based on experimentation, if the button is pressed by the patron for 4 minutes, the battery power will last for use by or 24 patrons. The three battery cells would already be connected together in plastic tubing ready for insertion into the molding when supplied. Such packs may be placed in a line or triangle configuration according to need. The sizes are 15.5 mm diameter by 6.3 mm thickness, so that a line pack of three will provide a block of 16 mm×48 mm×6.3 mm. These batteries have a "memory" and the charge should be fully depleted prior to recharging in order to maximize the life of the battery. However, there are many types of batteries which are suitable and any battery providing three hours of continuous or intermittent use is sufficient.

The LED lights can be supplied in various colors, which need only a 2 volt battery, whereas white lights use at least a 3 volt battery. This may be another option for trendier restaurants and entertainment establishments. In theaters and opera houses, a souvenir program could be sold with this device attached.

With the foregoing and other objects in view there is provided, in accordance with the invention, a device for illuminating single or multiple page reading material in dimly lit locations. The device comprises two or more hinged-together cover panels each having a holder for the single or multiple page reading material. The cover panels completely enclose the single or multiple page reading material in a closed condition and permit reading of the single or multiple page reading material in an open condition. An additional panel is hinged to one of said cover panels at the top or at the side. A lighting module is retained to said additional panel for directing light onto the single or multiple page reading material by independently moving said additional panel. The hinges may preferably be living hinges. The lighting module may be removably affixed to an outer surface of said additional panel or enclosed within said additional panel. The additional panel may be spring-biased to pop-up at an angle for illuminating the single or multiple page reading material.

With the objects of the invention in view, there is also provided a device for illuminating single or multiple page reading material in dimly lit locations. The device comprises at least one panel for holding the single or multiple page reading material, a lighting module, and a flexible strap connected to said at least one panel and retaining said lighting module for directing light onto the single or multiple page reading material. The flexible strap may have a tab to be inserted and retained within said at least one panel.

With the objects of the invention in view, there is additionally provided a device for illuminating single or multiple page reading material in dimly lit locations. The device comprises at least one panel for holding the single or multiple page reading material, a lighting module, and a lanyard connecting said at least one panel to said lighting module for directing light onto the single or multiple page reading material.

With the objects of the invention in view, there is furthermore provided a device for illuminating single or multiple page reading material in dimly lit locations. The device comprises at least one panel for holding the single or multiple page reading material. The at least one panel has a cavity formed therein. A lighting module is to be received in said cavity. A reel is enclosed within said at least one panel, and a lanyard has one end wound on said reel and another end connected to said lighting module, for directing light onto the single or multiple page reading material. The lighting module protrudes a sufficient distance from said cavity, with said lanyard retracted, to permit grasping of said lighting module.

With the objects of the invention in view, there is also provided a device for illuminating single or multiple page reading material in dimly lit locations. The device comprises at least one panel for holding the single or multiple page reading material. The at least one panel has a channel formed therein. A flexible strap sliding in said channel retains a lighting module for directing light onto the single or multiple page reading material.

In accordance with another feature of the invention, said cover panels each have an effective reading material receiving surface, and said additional panel is smaller or narrower than said effective reading material receiving surface of each of said cover panels.

In accordance with a further feature of the invention, a tray is embedded in said additional panel and said lighting module is releasably locked in said tray.

In accordance with an added feature of the invention, lighting module has a programmable microprocessor. The lighting module may be wireless and contain a battery, a push button and an LED. The lighting module may alternatively be rechargeable and contain a battery, a push button, an LED and a charging socket.

In accordance with a concomitant feature of the invention, the lighting module is one of a plurality of lighting modules, and a power distribution charging system with a plurality of charging wires or a plurality of cavities in a box, charges said plurality of lighting modules simultaneously.

Other features which are considered as characteristic for the invention are set forth in the appended claims.

Although the invention is illustrated and described herein as embodied in a device for illuminating reading material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 11, 12, 13 and 14 are respective top-plan, side-elevational, front-elevational and top-plan views of a second embodiment of a device according to the invention for illuminating reading material, in the form of a check presenter, in which FIGS. 11 and 14 show a lighting module at the top in respective folded and popped-up positions;

FIGS. 15, 16, 17 and 18 are respective top-plan, side-elevational, front-elevational and top-plan views of a third embodiment of a device according to the invention for illuminating reading material, in the form of an alternative check presenter, in which FIGS. 15 and 18 show a lighting module at the side in respective folded and popped-up positions;

DETAILED DESCRIPTION OF THE INVENTION

Figure 1:
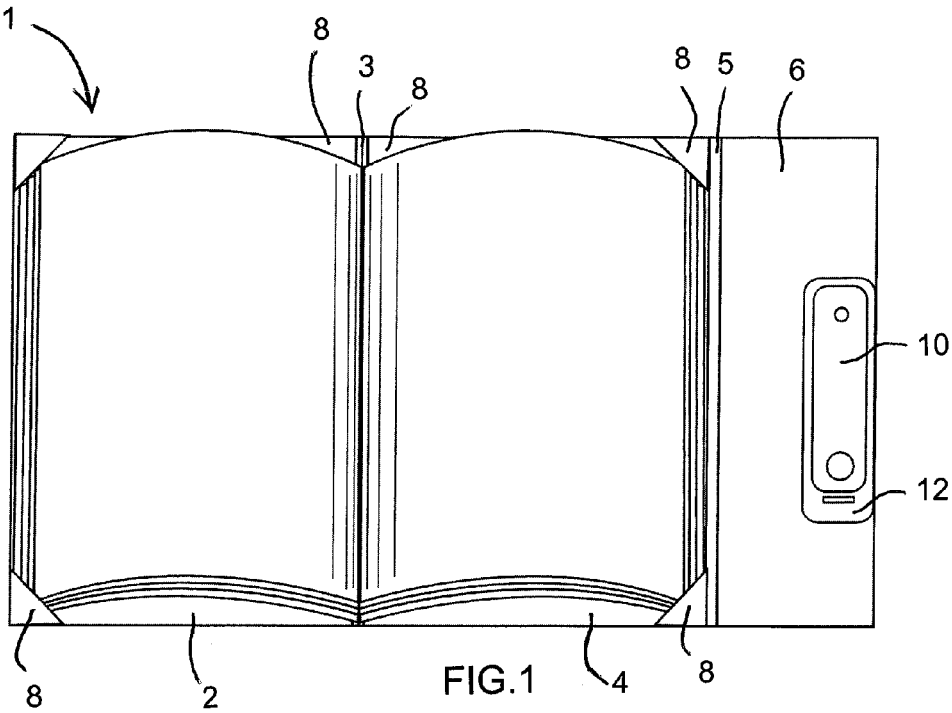
FIG. 1 is a diagrammatic, top-plan view of a first embodiment of a device according to the invention for illuminating reading material, in the form of a menu cover, having three panels and a wireless lighting module.

Referring now to the figures of the drawings in detail and first, particularly, to FIG. 1 thereof, there is seen a first embodiment of a device according to the invention for illuminating reading material, in the form of a menu cover 1, having three panels 2, 4, 6 interconnected by living hinges 3, 5, although the panels may also be attached by a standard hinge with a hinge pin or any other type of hinge mechanism, lanyard, binding or flexible fabrication. The first and second panels 2, 4 have holders or corner flaps 8 for holding corners of reading material, such as menus or the front and back covers of a book as shown. The panels may be made of leather, vinyl, fabric, cardboard or any other suitable material or could be a shrink-wrapped molding. Of course, more than two cover panels for holding reading material may be hinged together. If a living hinge is applied, then the spine of the hinge may be expanded to accommodate multiple pages and fold inside the top cover and rest comfortably on the top page. In the case of metal pin or clip hinges, the panel may fold over inside the back cover, underneath the last page.

The first and second panels 2, 4 are cover panels each having an effective reading material receiving surface covering substantially all of the surface of the panels between the holders 8. The cover panels 2, 4 completely enclose the single or multiple page reading material in a closed condition and permit reading of the single or multiple page reading material in an open condition. The additional panel 6 is narrower and thus smaller than the effective reading material receiving surface of each of the cover panels 2, 4.

The device is an extended version of a typical cover with two or more panels for reading material, such as is used in a menu or wine list holder or check presenter. However, the device is constructed to include the narrower third or additional panel 6. The third panel 6 may be shorter than or the same length as the panels 2, 4 as seen in the direction along the hinges 3, 4. The third panel 6 incorporates a multi-operational lighting device according to the invention, in the form of a wireless lighting module 10 in a tray 12. The lighting module may be approximately between 4.5 mm and 6 mm thick.

During production, the third panel 6 is dye cut to accommodate the tray 12 at the center of the outer edge, which in turn accepts the wireless lighting module 10 for maximum dispersement of a light beam across the pages. The flexible living hinge allows illumination of single and multiple pages and does not interfere with or hamper the turning of the pages. The third panel 6 folds over inside the menu cover when not in use.

The module or cassette 10 may be a wired module which is removed from the tray 12 so that non-rechargeable batteries may be exchanged. Alternatively, if rechargeable batteries are used, they may be charged in a power distribution system, such as a multi-point daisy chain or multi-wired power distribution charging system described below, and then re-inserted for use.

Figure 2:
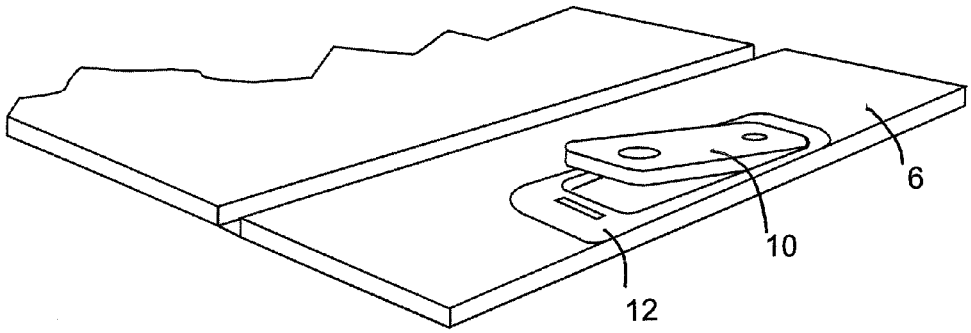
FIG. 2 is a fragmentary, perspective view of the device according to FIG. 1 with the wireless lighting module partially removed from its lockable tray.

FIG. 2 illustrates how the lighting module 10 is removed from or inserted into the tray 12. A die cut space in the third panel 6 accommodates the tray 12 with a locking mechanism. The tray, which is locked or adhered in the space in the menu cover, allows for insertion and removal of the module by using a simple release tool.

Figure 3:
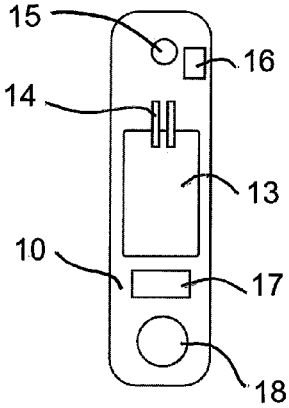
FIG. 3 is a plan view of the wireless lighting module with its encasement removed to reveal components thereof.

An encasement of the wireless module 10 has been removed in FIG. 3 to show the interior thereof module. A PCB (printed circuit board) accommodates all of the components required for operation of the lighting module, as explained below.

One or more batteries 13, preferably in a lithium polymer flat pack, which is 3.7 volt rechargeable, are connected to the PCB by contacts 14, although less expensive alternatives may substituted, such as rechargeable nickel metal hydride (NiMH) batteries, which have 3 button cells in a flat pack, or disposable Ni-Cad batteries, which have 3 AAA batteries in a tubular pack.

One or more LED's (Light Emitting Diodes) 15 are mounted directly onto the PCB as a source of illumination. Although white light is preferable for maximum illumination, multiple custom-colored, lower powered alternatives may be substituted. The LED is contained in a molding which has a reflective angled frame to enable the beam to illuminate the maximum area of the pages.

A resistor circuit (or microchip or programmable microprocessor) 16 is mounted directly onto the PCB and regulates current flowing to the LED for control and timing in order to conserve battery power. This will also allow for the indication of a drop in power, alerting a proprietor to the need to recharge the module 10 in the case of non-rotation or excessive use, to safeguard against a patron receiving a non-working unit. Added software featured in the circuit control indicates that the charge is fully completed when connected to a power source. The device is then disconnected and ready for use or the wireless module may locked back into place and be read for use.

A charge control 17, which is provided in rechargeable units, limits power to a trickle charge as a safety measure and to extend the life of the battery. This feature may be optionally contained in either the module or a power distribution receptacle.

A push button switch 18 is mounted directly to the PCB and recessed in order to prevent operation of the light when the reading material cover is closed. When held in a depressed position, it will illuminate until released for battery conservation. When in a timed mode, depressing the button will restart the timed illumination. A push button released by the patron will save battery life and will help to ensure that recharging is more uniform.

Figure 4:
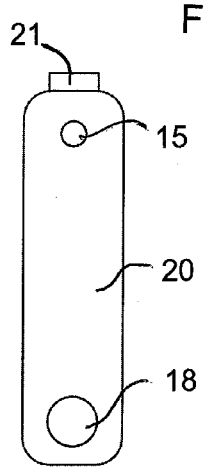
FIGS. 4, 5 and 6 are respective top-plan, side-elevational and bottom-plan views of the encasement of the wireless lighting module.

FIG. 4 illustrates an injection molded plastic or fireboard encasement 20 of the module 10 for all of the various components. The encasement 20 has a smooth outline to allow insertion of the module 10 into the tray 12 in the reading material or menu cover, etc. The LED 15 and push button 18 are exposed for use.

Figure 5:
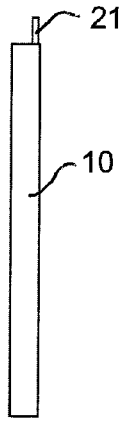
Figure 6:
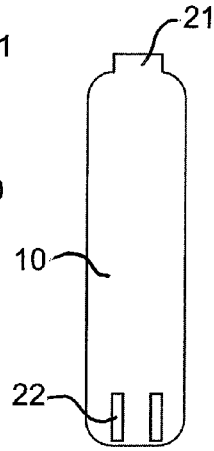

FIG. 5 is a side view of the module 10 illustrating a slim compactness of the module, which is important for a streamline and aesthetic appearance and size of the finished product. FIG. 6 shows the underside of the module, illustrating gold contacts 22 which, when connected to corresponding contacts in a power distribution receptacle, enable wireless charging like that of a mobile phone. FIGS. 4, 5 and 6 also show a tab 21 on the encasement 20 for latching in a slot in the tray 12.

Figure 7:
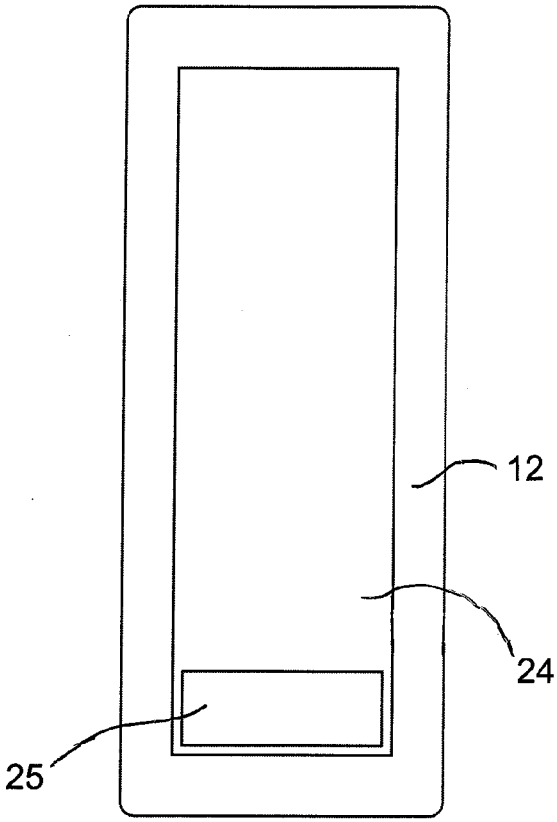
FIG. 7 is an enlarged, top-plan view of the tray removed from the panel of the device.
Figure 8:
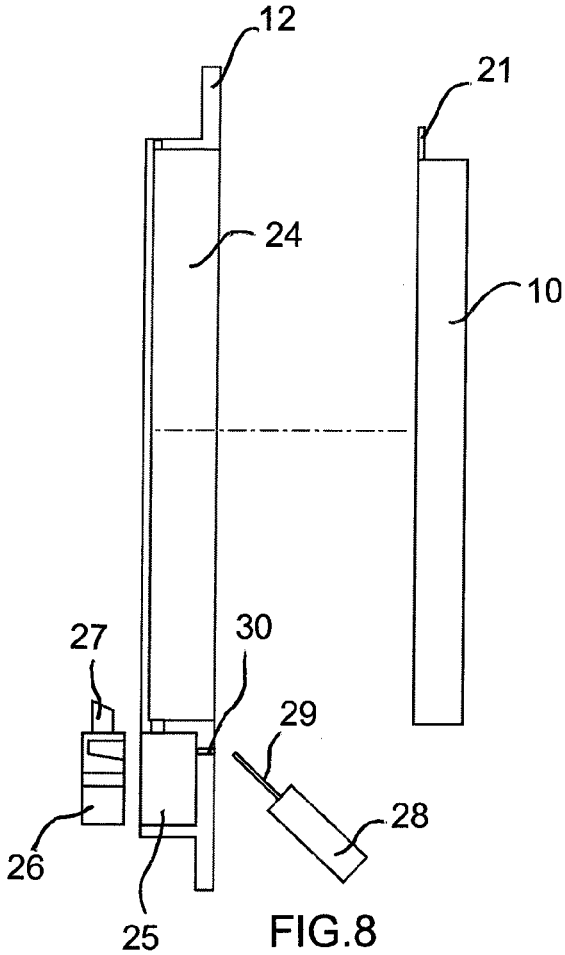
FIG. 8 is an exploded, side-elevational view of the tray, the wireless lighting module, a locking clip and a release tool.
Figure 9:
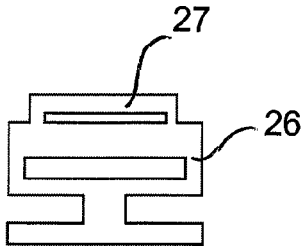
FIGS. 9 and 10 are enlarged, top-plan views of a spring clip and the release tool.
Figure 10:
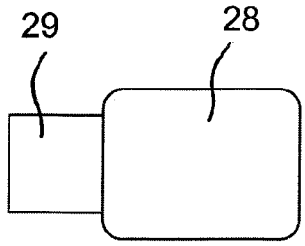

FIG. 7 shows the tray 12 having a holding receptacle or space 24 into which the wireless module 10 is inserted for use and released for recharging, as well as a lock 25. FIG. 8 is an exploded view showing the tray 12, the holding receptacle 24 and the module 10 to be inserted therein. The lock 25 has a spring release mechanism or resilient locking clip 26 with a protrusion 27 bearing against the wireless module 10 for locking the module into the tray 12. The module is released through the use of a simple release tool or implement 28 having a protrusion 29 to be inserted into a slot 30 for moving the protrusion 27 and releasing the module. This prevents loss and damage of the module. FIG. 9 is a plan view of the spring release locking mechanism 26. FIG. 10 shows the tool 28 which, when inserted correctly, will allow the release of the module 10 from the holding receptacle 24.

The living hinge, which is part of the molding, may be used for all folders, menus, ring binders or reading material, etc. The service life of such a hinge in the molding exceeds the service life of the remainder of the menu cover. It is permanently fixed to the menu cover with a self-adhesive strip, rivets or stitching. The open face of the hinge and the molding are covered in any material desired to match the menu or reading material or simply for styling. The living hinged embodiment is very simple to manufacture and easy for the user to attach to the menu cover. The manufacturing cost is also lower than for spring hinges.

The living hinge may have a variation in thickness which is selected to accommodate the measured thickness of various menus or reading material. The overall sizes of the menus or reading material also determine how long to make the molding. The menus or reading material which are contemplated are between 6 mm and 9 mm thick, but the invention is not limited thereto.

FIGS. 11-14 illustrate a second embodiment of the device in the form of a check presenter 31, having first and second panels 32, 34 with a living hinge or other simple hinge mechanism 33 therebetween. The cover panels completely enclose the reading material in a closed condition and permit reading of the reading material in an open condition. The first and second panels are cover panels each having an effective reading material receiving surface covering substantially all of the surface of the panels. A third or additional top panel 36, which is smaller than the effective reading material receiving surface, is attached to the panel 34 by a living hinge or other simple hinge mechanism 35. A lighting module 40, which is attached to or forms the top panel 36, has a push button 41 and an LED 42, so that a beam of light will diffuse down the page to illuminate charges incurred for visual aid in ambient lighting.

The check presenter can be a smaller version of the device shown in the previous figures and is used for much shorter periods. The check presenter needs less power to illuminate a smaller area for a shorter time, hence smaller batteries and LED power, however the compact size of the device makes it universally feasible due to the optional features in the resistor/microchip software. When used for signing, the user will need to have a pen in one hand so as to be easy to use for both right and left handed people. The light may be illuminated automatically for a timed period when the cover is opened. Alternatively, a simple touch of the push button puts the light on for a preset interval to leave both hands free.

Figure 11:
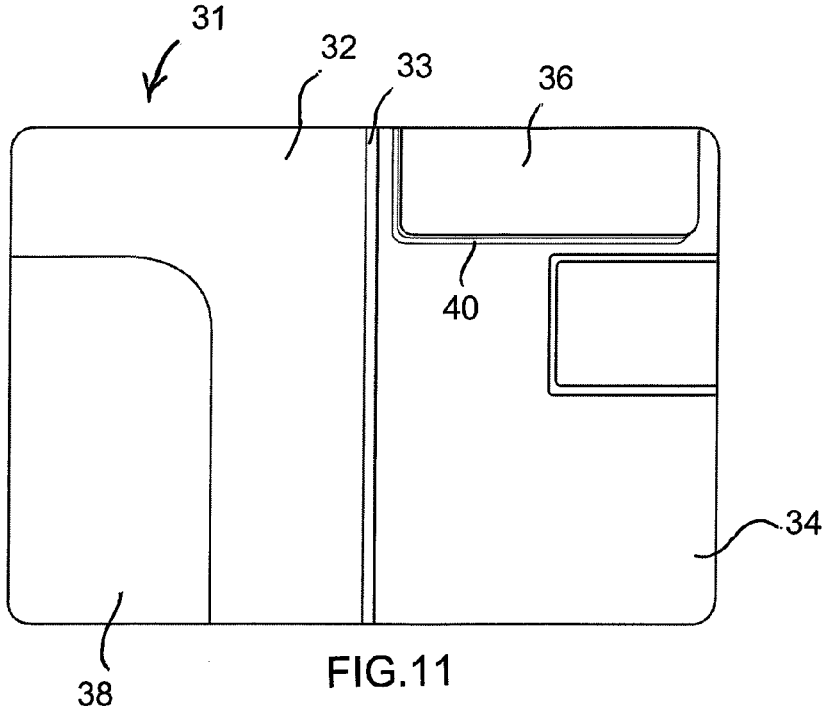
Figure 12:
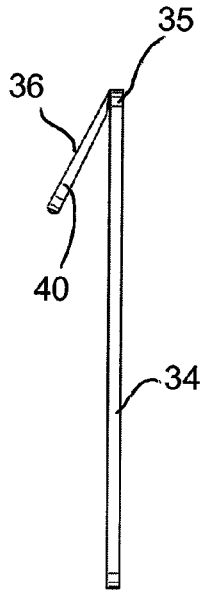
Figure 13:
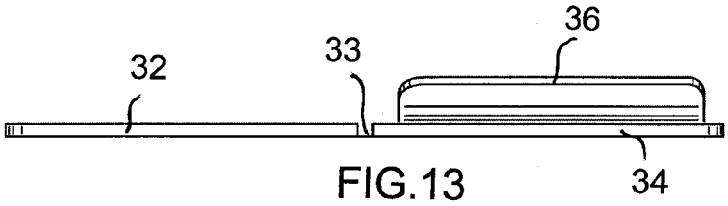
Figure 14:
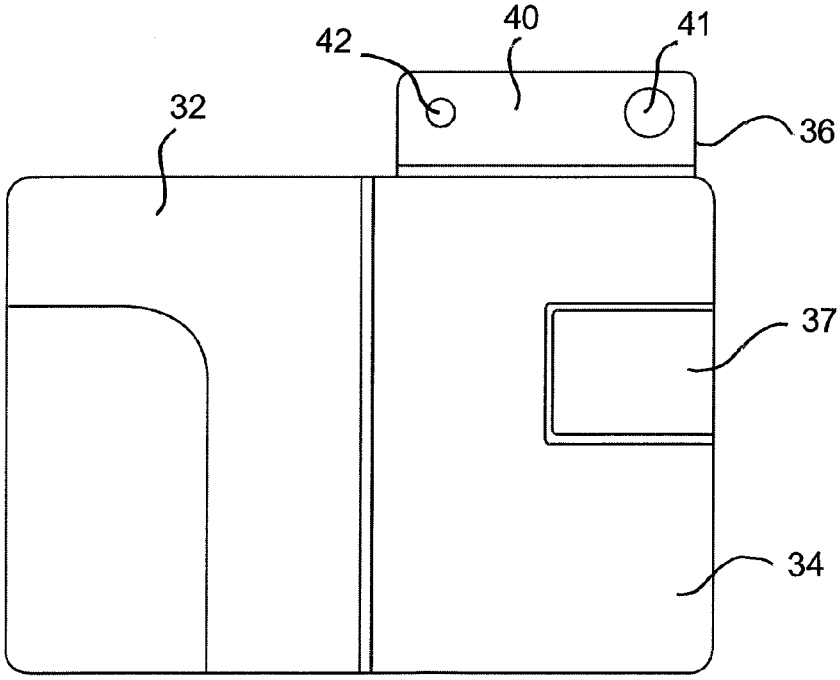
Figure 15:
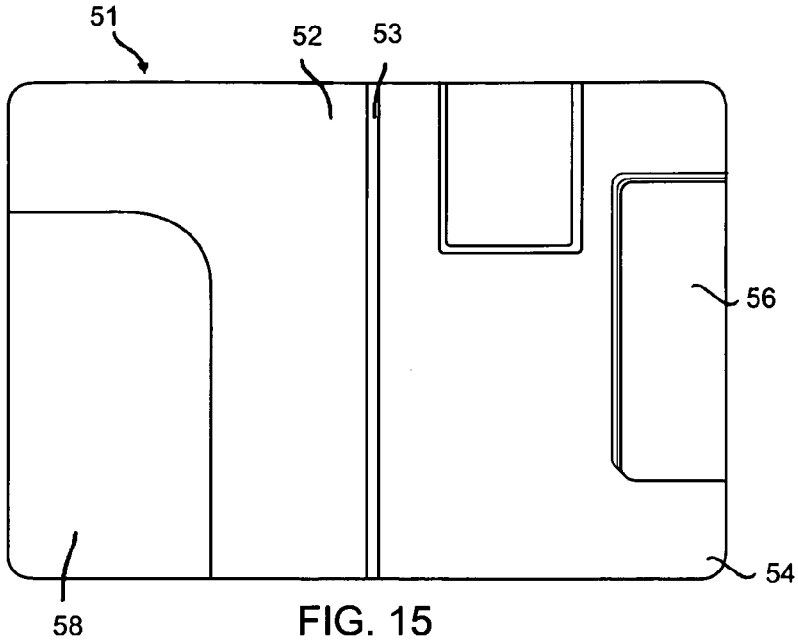

Whereas FIG. 11 shows the panel 36 and the module 40 folded down for compact easy storage, prevention of stress, tearing or damage when stacked and stored, FIG. 12 shows the module in a position in which it is popped-up by approximately 45 degrees and will illuminate a page and FIG. 14 shows it unfolded and not in use. The panel can be moved to illuminate either side of the presenter for versatility and comfort of the user as in the larger model. FIG. 13 shows a view of the panel 36 with an optional simple spring mechanism which causes the module 40 to pop up when the presenter is opened to activate a circuit control and cause automated timed illumination of the reading material for hands-free viewing and signing of a check. Additional time may be reset by depression of the push button 42. A transparent credit card sleeve 37 and a check flap 38 are also provided.

Figure 17:
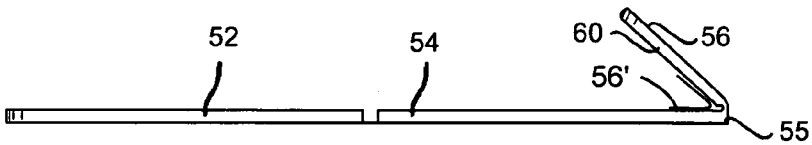
Figure 18:
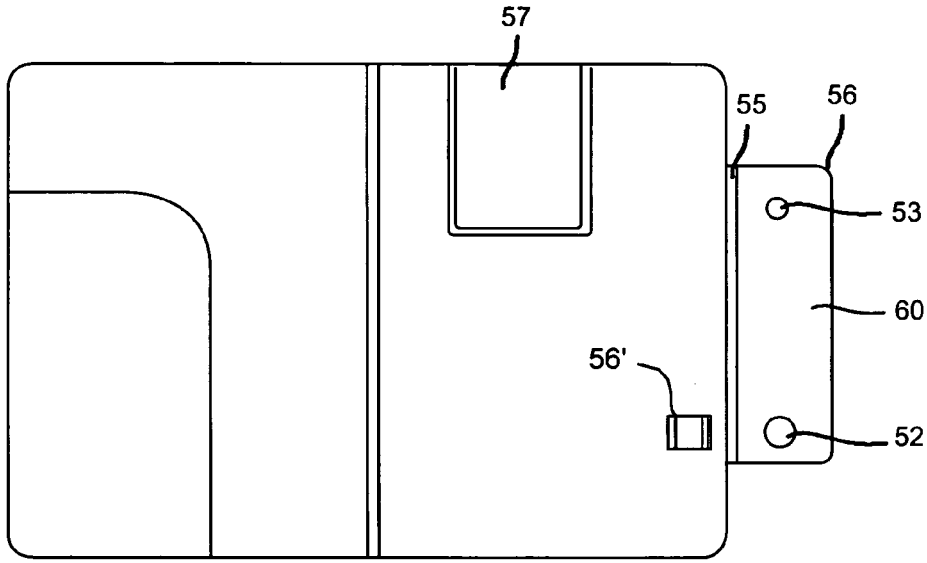
Figure 19:
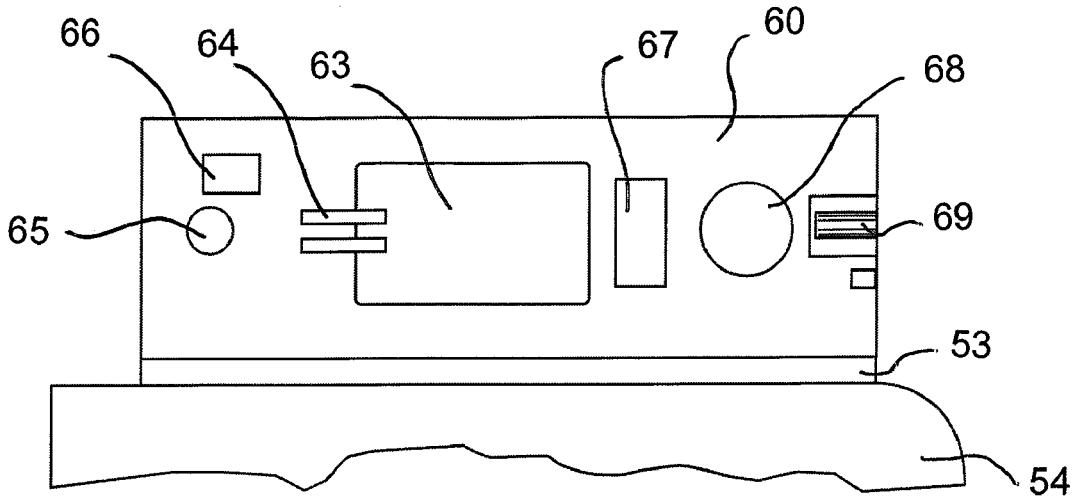
FIG. 19 is a fragmentary, enlarged, top-plan view of an interior of the lighting module showing components thereof.
Figure 20:
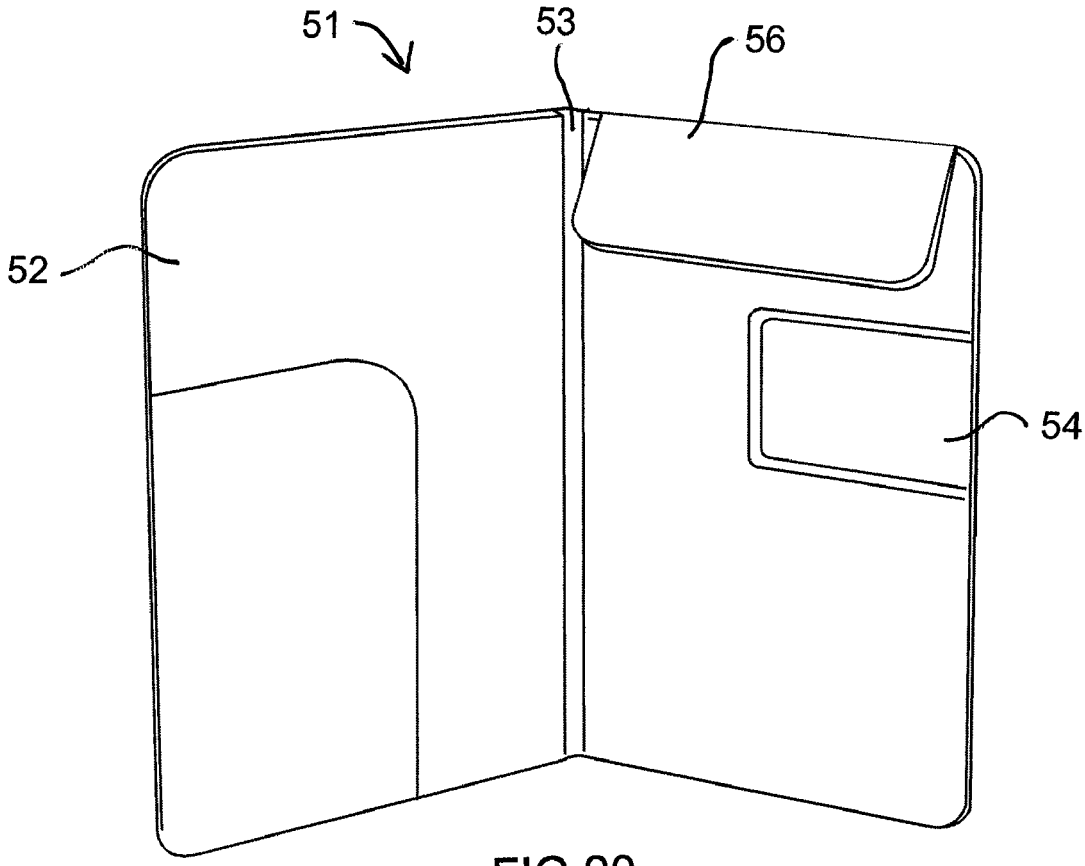
FIG. 20 is a perspective view of the check presenter of FIG. 11, with the top lighting module partially popped-up.

FIGS. 15-20 illustrate a third embodiment of a device in the form of an alternative check presenter 51, having first and second panels 52, 54 with a living hinge or other simple hinge 53 therebetween. The first and second panels are cover panels each having an effective reading material receiving surface covering substantially all of the surface of the panels. The cover panels completely enclose the reading material in a closed condition and permit reading of the reading material in an open condition. A third or additional panel 56, which may be narrower or smaller than the effective reading material receiving surface, at the side of the check presenter in FIGS. 15-18 and at the top of the check presenter in FIGS. 19 and 20, is attached to the second panel 54 by a living hinge or other simple hinge 55 and has a lighting module 60 attached to or forming the top panel 56.

Figure 16:
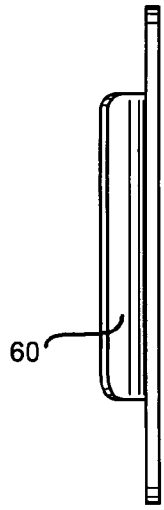

FIG. 16 illustrates the lighting module 60 when folded and not in use. The panel 56 may be folded inside the check presenter to conserve storage space and to protect the device from damage. A further option may be offered in the form of a simple hook and loop or press fastener to attach the device to the top exterior of the cover as in a personal agenda cover. FIG. 18 shows the panel 56 with the lighting module 60 fully extended, rotated 180 degrees, and also not in use. FIGS. 17 and 20 illustrate the spring-loaded panel 56 automatically popped-up by a spring 56' and angled so that a light beam from an LED 53 which spreads across the page may be illuminated manually by a push button 52 or automatically by circuit control software activated to enable hands-free inspection and signing of the displayed check. A transparent credit card sleeve 57 and a check flap 58 are once again provided.

FIG. 19 shows the lighting module 60 with an encasement removed to reveal the interior of the module having a battery 63, contacts 64 connecting the battery, an LED 65, a resistor circuit 66, a charge control 67, a push button switch 68 and a charging socket 69, mounted to a PCB. Circuit control software for automatic timed illumination and push button options are provided.

Figure 21:
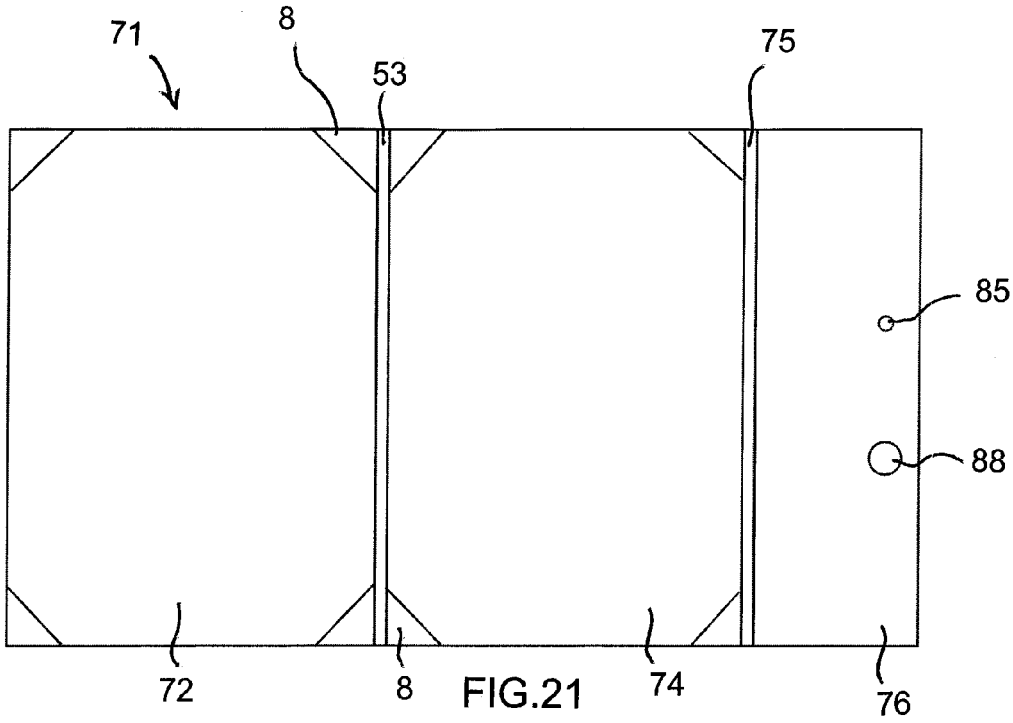
FIGS. 21 and 22 are respective top-plan and fragmentary, perspective views of a fourth embodiment of a device according to the invention for illuminating reading material, in the form of an alternative menu cover, having three panels and a built-in, rechargeable lighting module.
Figure 22:
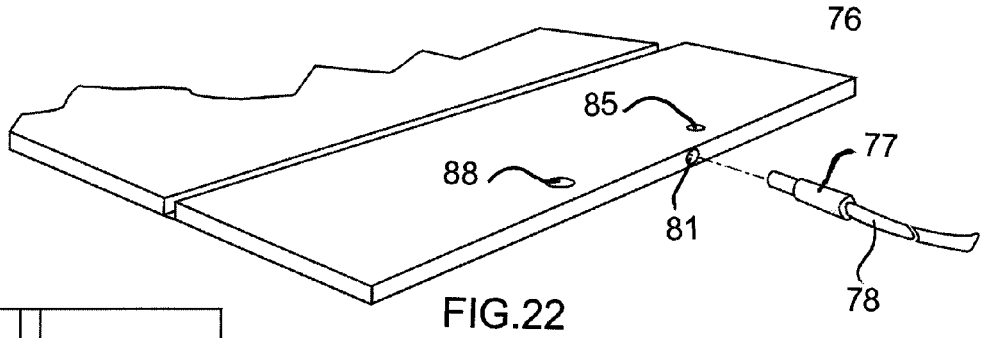
Figure 23:
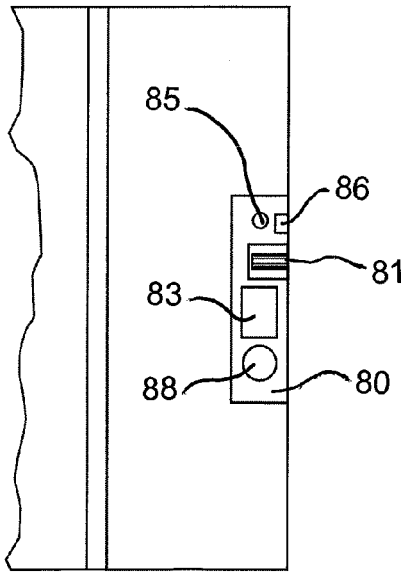
FIG. 23 is an enlarged, fragmentary, top-plan view of the device of FIG. 21, showing components of the lighting module.
Figure 27:
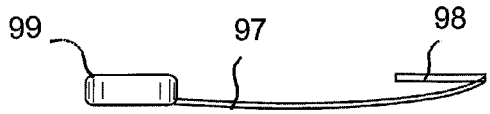
FIGS. 24, 25, 26 and 27 are respective top-plan, left side-elevational, right side-elevational and rear-elevational views of a fifth embodiment of a device according to the invention for illuminating reading material, in the form of a molding and a shaped strap for attachment of a molding and the wireless lighting module according to FIGS. 7 and 8 to an existing menu cover.
Figure 25:
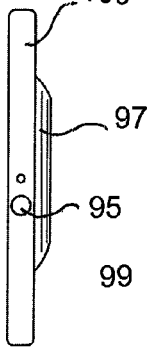
Figure 24:
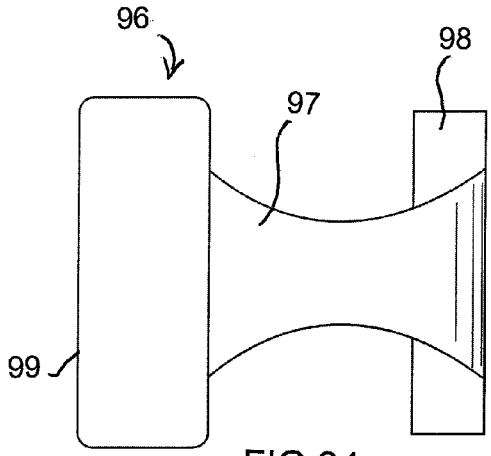
Figure 26:
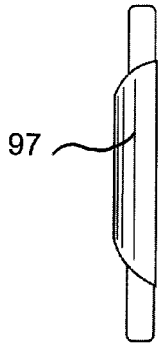

FIGS. 21-23 show a fourth embodiment of the device in the form of an alternative menu cover 71, having first and second panels 72, 74 with a living hinge 53 therebetween and a third or additional panel 76 attached to the second panel 74 by a living hinge 75. The first and second panels are cover panels each having an effective reading material receiving surface covering substantially all of the surface of the panels between the holders 8. The cover panels completely enclose the reading material in a closed condition and permit reading of the reading material in an open condition. The third panel is narrower or smaller than the effective reading material receiving surface and extends to maximize the light beam on the reading material.

The menu cover 71 has been custom die-cut to fully enclose a lighting module 80 in the third panel 76 for aesthetic and streamlining as an alternate option to a wireless or disposable module. This module 80 is recharged by a simple multi-wired power distribution box, or daisy chain style power supply, described below. FIG. 22 illustrates the cover 71 with the panel 76 housing the module 80 extended and ready for recharging by inserting a barrel connector 77 on a wire 78 from the power distributor into a charging socket 81 housed in this variation of the module 80.

FIG. 23 shows the panel 76 housing the module 80 with the charging socket 81, a battery 83, an LED 85, a resistor circuit 86 and a push button switch 88, mounted to a PCB.

Figure 28:
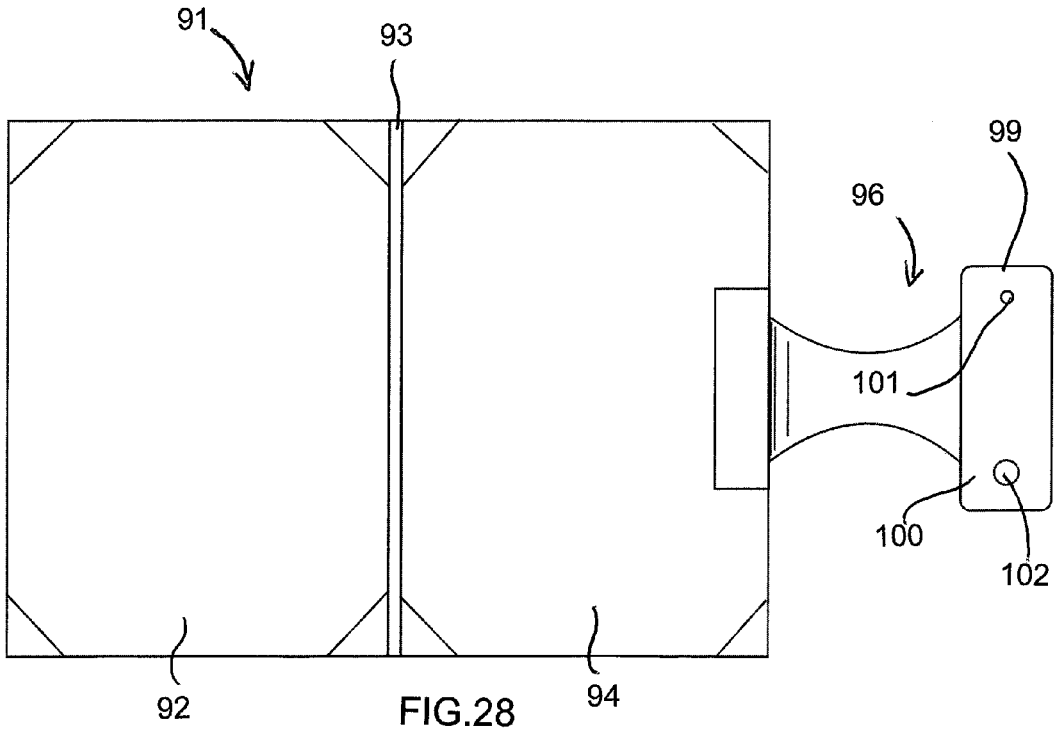
FIGS. 28 and 29 are top-plan views showing the molding of FIG. 24 attached to a menu cover and being swung-out for turning a page of a multi-page menu or book in FIG. 28 and swung-in for use in FIG. 29.
Figure 29:
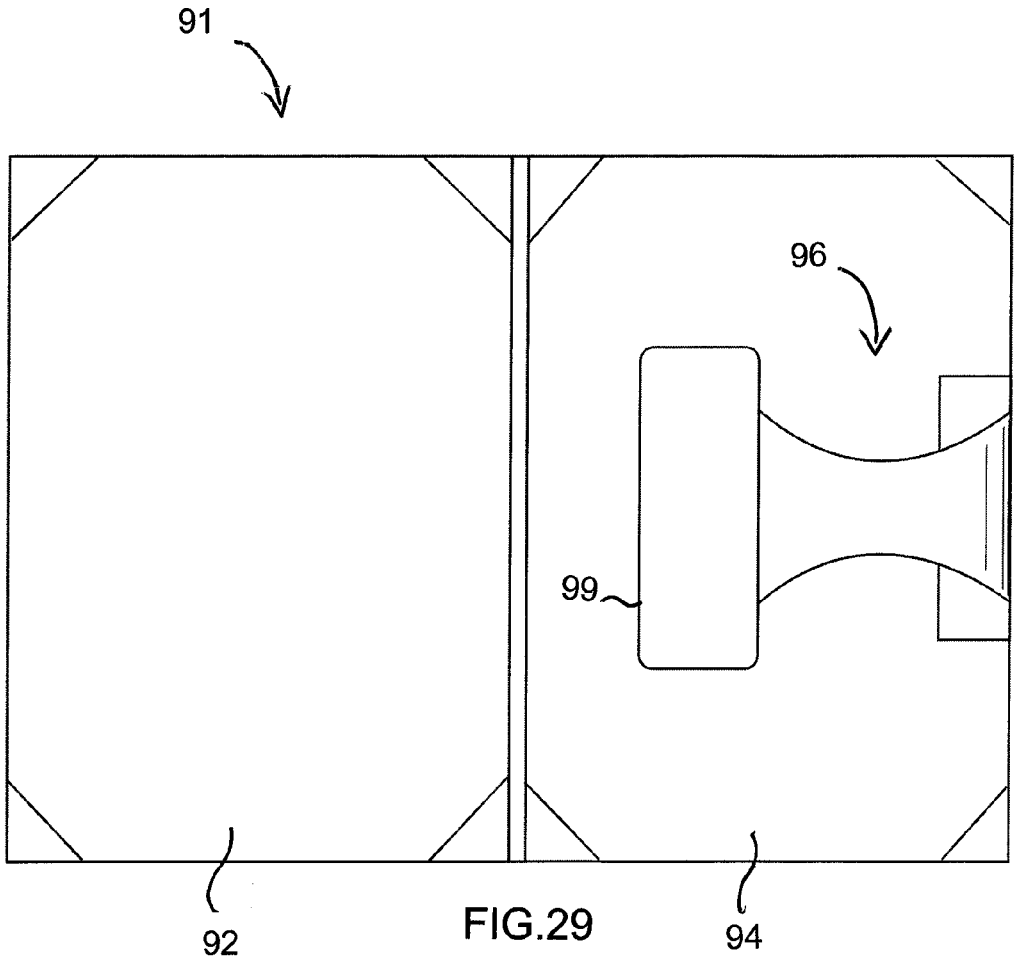

FIGS. 24-29 show a fifth embodiment of a device in the form of a slender, streamlined, flexible molding 96 having a shaped strap 97 and an insert or tab 98 for attachment of an encasement 99 and a wired or wireless lighting module 100 with an LED 101 to an existing menu cover 91. FIG. 28 shows the molding 96 swung-out for turning a page of a multi-page menu or book and illustrates on/off control of the lighting module 100 by a push button 102. FIG. 29 shows the molding 96 swung-in for use. When closed, the flexible strap is folded over the top page and the front cover closes over all affording protection for the device. The menu cover 91 has first and second panels 92, 94 with a living hinge 93 therebetween. The first and second panels are cover panels each having an effective reading material receiving surface covering substantially all of the surface of the panels between the holders 8. The cover panels completely enclose the reading material in a closed condition and permit reading of the reading material in an open condition. The lighting module 100 is smaller than the effective reading material receiving surface.

The molding 96, which is smaller than the effective reading material receiving surface, uses a flexible polymer or other fabric or flexible clear plastic, into which the holding receptacle or encasement 99 is adhered and contained. The wireless module 100 is inserted in the encasement 99. The wider insert or tab 98 at the end of the flexible strap 97 adheres on both sides, such as through the use of double-sided tape, and is inserted between an inside lining and a back of the panel 94 of the cover 91 for the material to be illuminated. The tab may also be stitched in place. This type of attachment will allow for the easy installation of the module 100 into existing covers and will alleviate the necessity for custom die cut panels, thus reducing labor time and costs in manufacturing. The flexibility of the strap 97 will allow for more accurate angling and placement of the light beam for more maneuverability and ease of viewing. When not in use, the strap will sit comfortably on top of the inner leaves of the reading material. In the case of a permanent wire-charged module using a charging socket 95, the flexible strap 97 will extend outside the cover 91 while connected to the power distributor. A sliding magnifying membrane may be added for the aid of patrons with poor vision or to enlarge small print.

Figure 30:
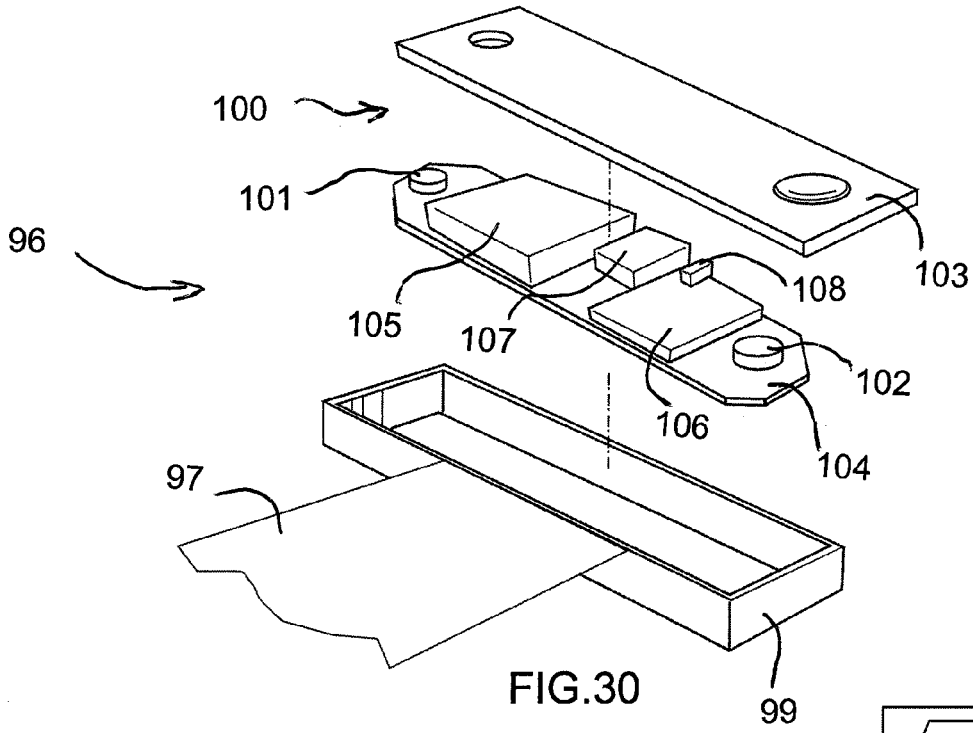
FIG. 30 is a fragmentary, exploded, perspective view of a rechargeable lighting module with a side-mounted rectangular strap.
Figure 31:
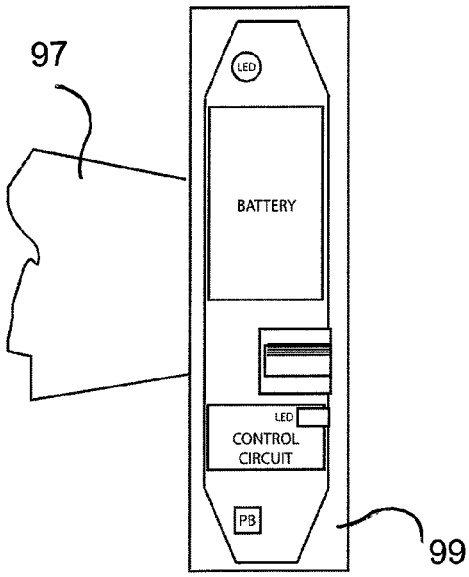
FIGS. 31 and 32 are fragmentary, top-plan views showing the interior of the molding of FIG. 30, with respective side-mounted and bottom-mounted shaped straps.
Figure 32:
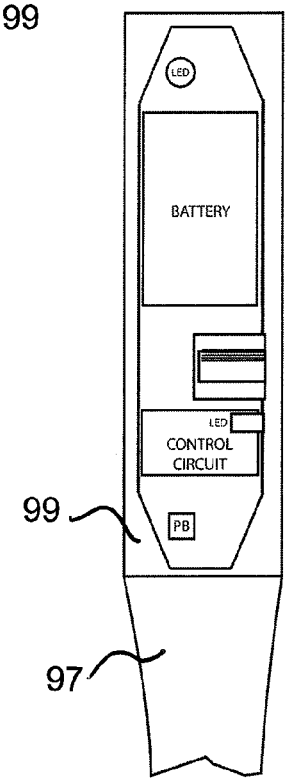

FIG. 30 is an exploded view showing the components and assembly of the molding 96 including the encasement 99, the wire-charged lighting module 100 with a cover 103, a PCB 104 having an LED 101 which may be angled for spreading a light beam, a non-illustrated resistor circuit, a battery 105, a charge control circuit 106, a charging socket 107, a push button 102 and an optional LED charge indicator 108. The flexible strap 97 connected to the encasement 99 may be attached to the cover 91 for reading material by an adhesive coating on the non-illustrated tab 98. The encasement 99 shown in FIG. 31 employs a strap 97 which widens toward the tab 98 and the encasement 99 shown in FIG. 32 employs a strap 97 which is to be vertically attached to the spine or base of the reading material as an optional alternative.

Figure 33:
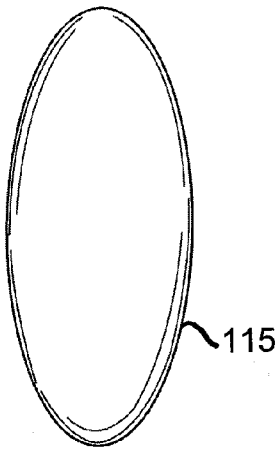
FIGS. 33-36 illustrate a sixth embodiment of a device according to the invention for illuminating reading material, in the form of a menu cover having a wireless lighting module attached by a lanyard, in which various shapes of the lighting module are shown.
Figure 34:
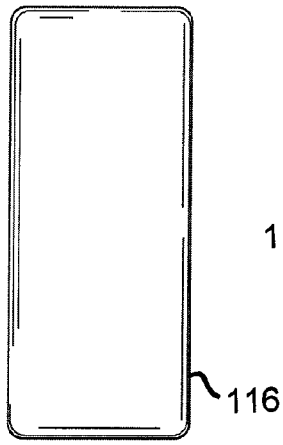
Figure 35:
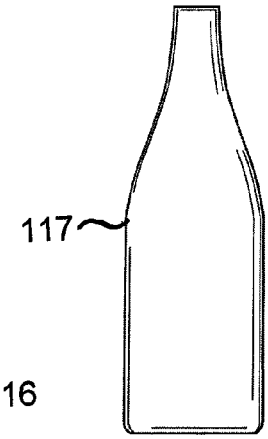
Figure 36:
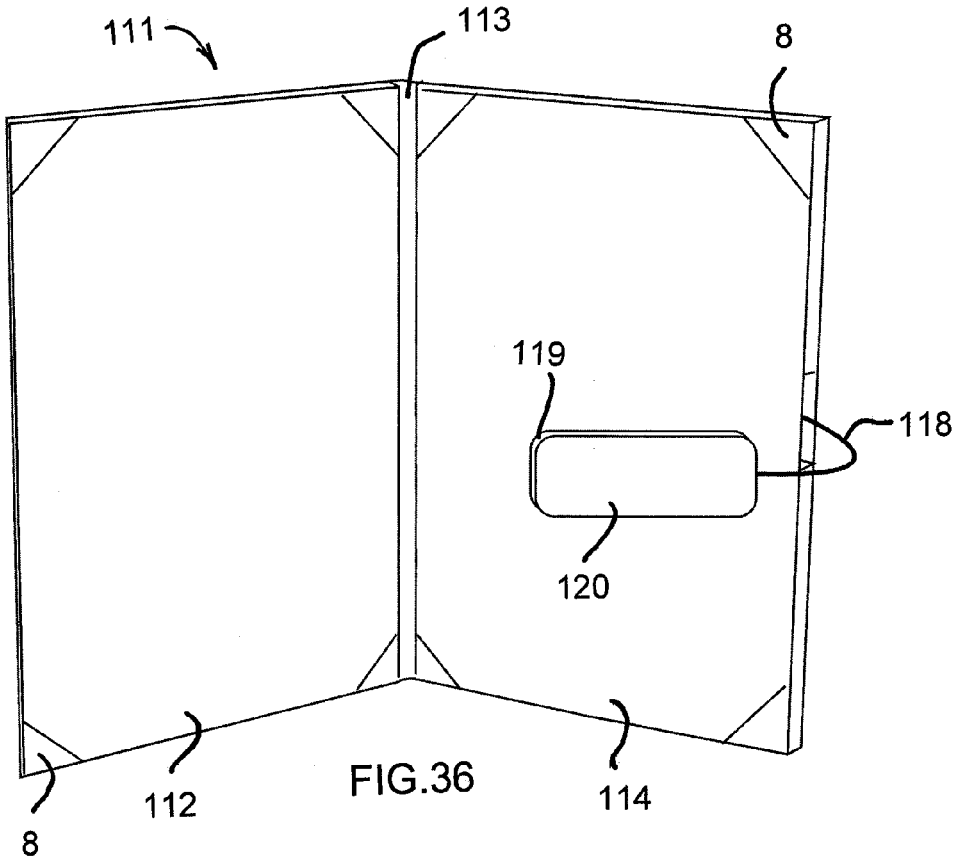
Figure 37:
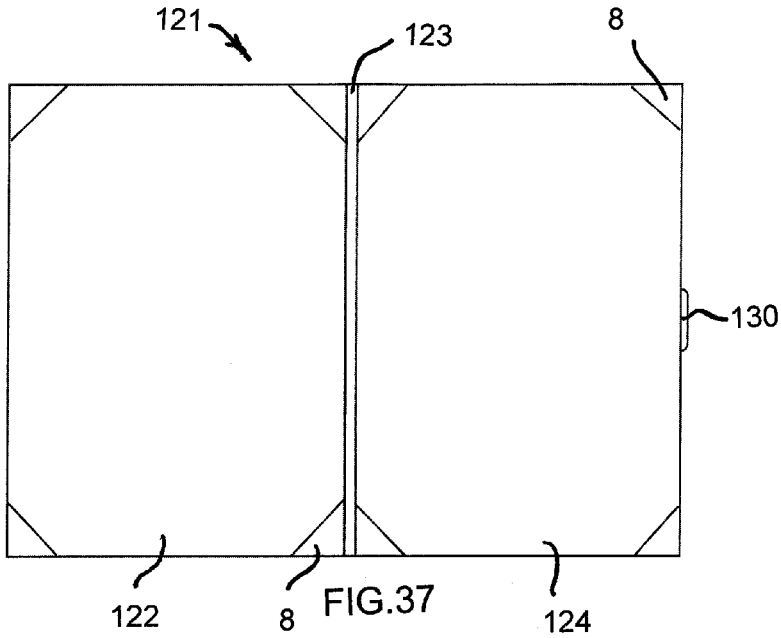
FIGS. 37, 38 and 39 are respective top-plan, side-elevational and partly broken-away top-plan views of a seventh embodiment of a device according to the invention for illuminating reading material, in the form of a menu cover having a rechargeable lighting module protruding slightly from a cavity for accessibility and attached by a lanyard on a retractable reel.
Figure 38:
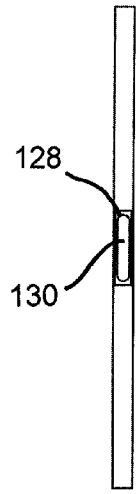
Figure 39:
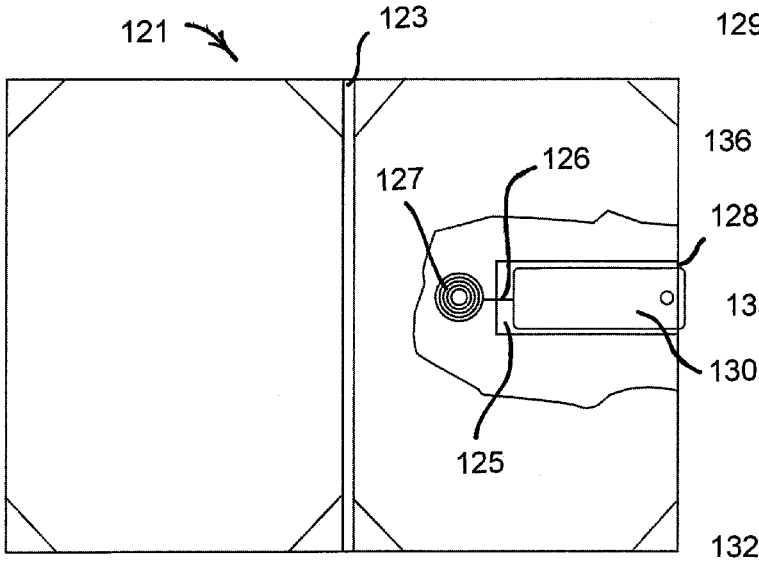

FIGS. 33-36 illustrate a sixth embodiment of a device in the form of a menu cover 111 having a wireless lighting module 120 in an encasement 119 attached by a lanyard 118. A reel for the lanyard may be disposed in the module or in the panel 114, similar to that shown in FIG. 39. Similarly, a lighting module could be attached with a lanyard to the back of a theater, arena or stadium seat located in front of the person using the light and the reel could be placed in the back of the seat or in the module. First and second panels 112 and 114 have a living hinge 113 therebetween. The first and second panels are cover panels each having an effective reading material receiving surface covering substantially all of the surface of the panels between the holders 8. The cover panels completely enclose the reading material in a closed condition and permit reading of the reading material in an open condition. Variously shaped encasements 115, 116, 117 for lighting modules are shown in FIGS. 33, 34 and 35, namely oval, rectangular and wine bottle-shaped, to illustrate the fact that custom designs may be used. Almost any shape encasement can be fabricated by injection molding to incorporate the module 120, which is smaller than the effective reading material receiving surface, for attachment to the cover 111 for reading material. These shapes can represent a signature for goods or an establishment and in addition can be embellished with advertising and public relations graphics and material. A custom molding may optionally contain a lanyard mechanism to simplify the installation of the device.

Figure 40:
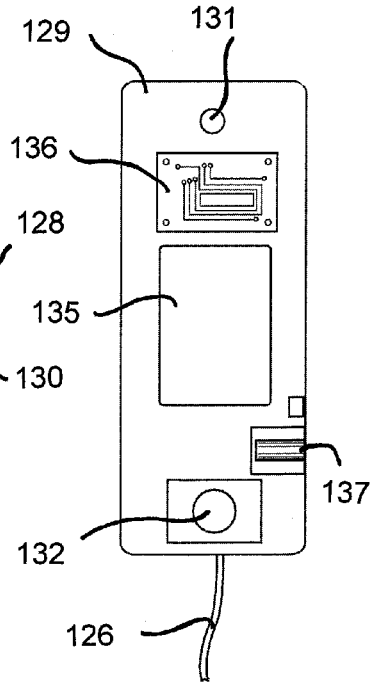
FIG. 40 is an enlarged, top-plan view of the interior of the wireless lighting module of FIGS. 37-39 to be attached by a lanyard.

FIGS. 37-40 disclose a seventh embodiment of a device in the form of a menu cover 121 having first and second panels 122, 124 with a living hinge 123 therebetween. The first and second panels are cover panels each having an effective reading material receiving surface covering substantially all of the surface of the panels between the holders 8. The cover panels completely enclose the reading material in a closed condition and permit reading of the reading material in an open condition. A lighting module 130, which is smaller than the effective reading material receiving surface, is disposed in a cavity 125 when not in use and protrudes slightly from an aperture 128 in the outer edge of the panel 124 for accessibility. The lighting module 130 is attached to the panel 124 by a lanyard 126 on a retractable reel 127, which allows extension of the lanyard. FIG. 40 shows components within an encasement 129 of a chargeable lighting module 130, with the cover removed, in which an LED 131, a push button 132, a battery 135, a charging circuit 136 and a charging socket 137, can be seen.

The lanyard or cord may be made from a silk, cotton, nylon or other length of material approximately 15" in length, at its longest extent. The retractable reel can be integrated in the device as illustrated by embedding it between a backing and an adhering lining of the cover, in the body of the cover or in the spine of the cover. Alternately, the reel may be embedded into a die cut inside the cover at the time of manufacture as illustrated.

The lanyards are made on a small bobbin that spins around a central pin with very low friction. This bobbin has a spiral spring inside which provides the retraction and is wound up as the cord is pulled. The lanyard is applicable to multi-sheet as well as single-sheet menus. The drawings show a lanyard which is mounted onto the menu cover and locates and holds the light panel when it is not in use. This reduces the weight of the panel and also keeps the light panel in place when it is not in use but still allows recharging.

Another option, recognizing that the light panel only needs to be moved a short distance, is to use a piece of elastic in a tube along the length of the light panel, which could extend 3 or 4 times its length to provide sufficient flexibility for use. A cord or elastic could use hook and loop fasteners, such as Velcro or a magnet to keep them in place inside the menu when not in use.

Figure 41:
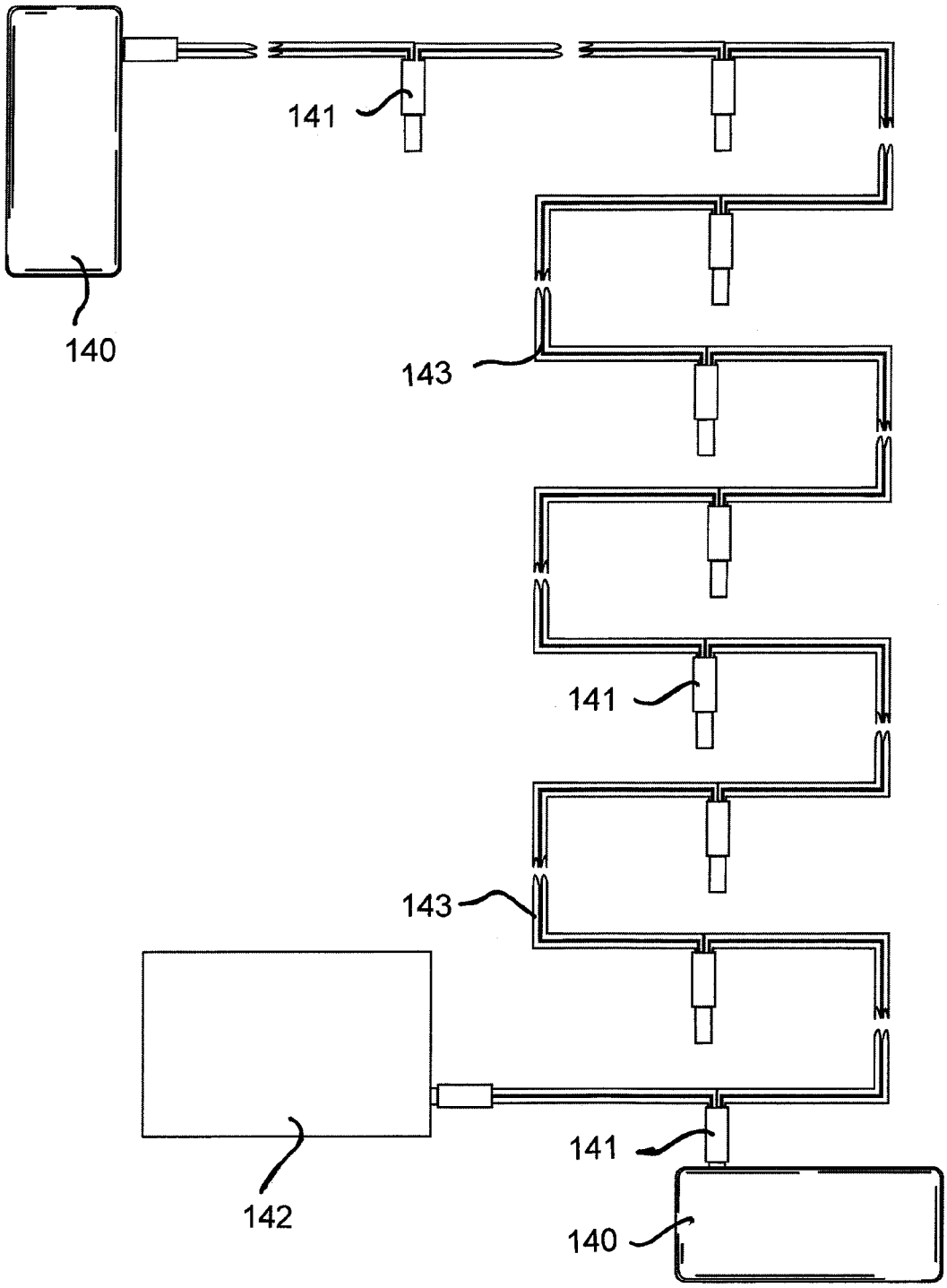
FIG. 41 is a top-plan view of a so-called daisy chain charging system connected to lighting modules and a power pack.
Figure 42:
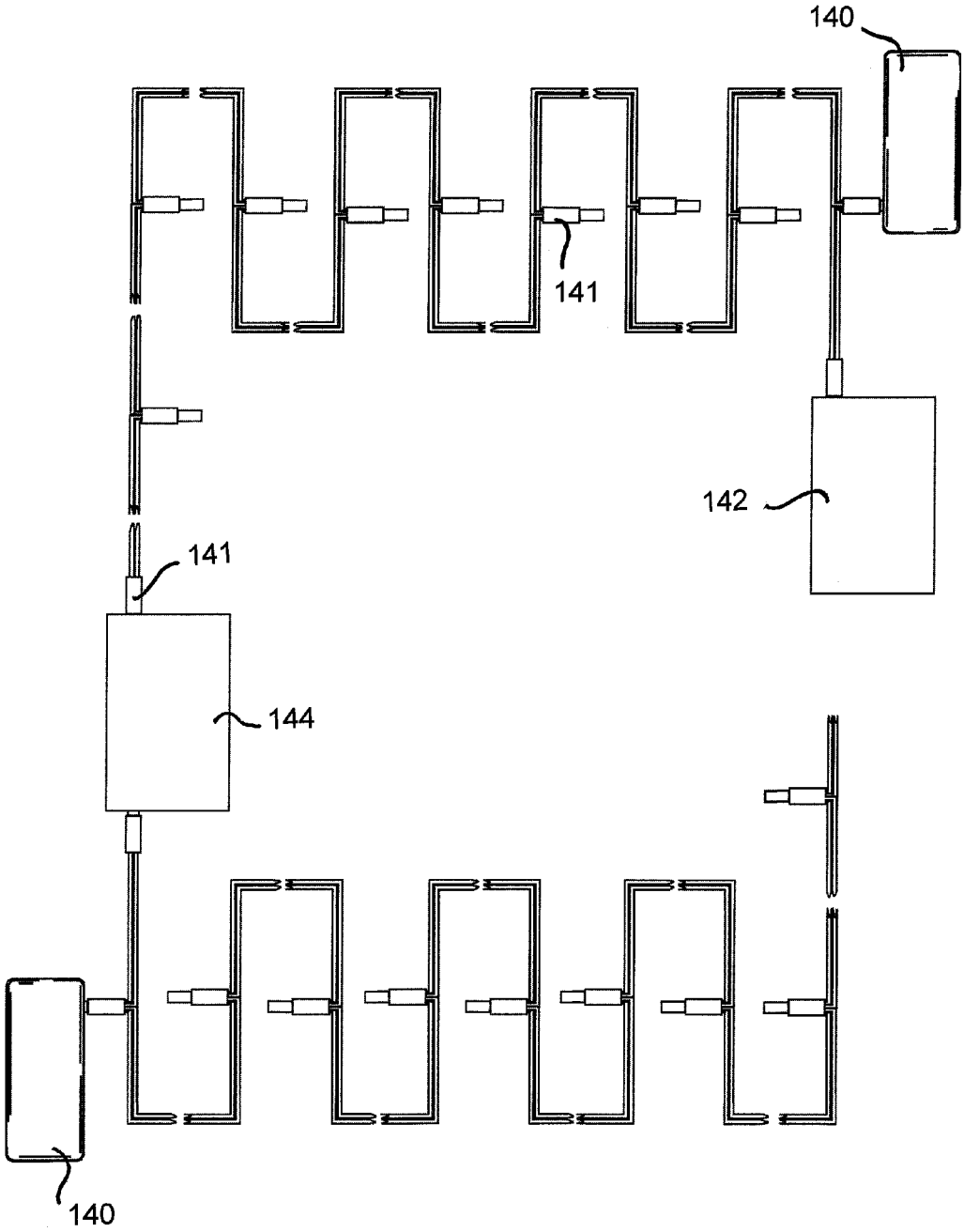
FIG. 42 is a top-plan view of two daisy chain charging systems connected to lighting modules and interconnected by a multi-point charger.

FIG. 41 is a fragmentary view of a multi-point power distribution charging system in a so-called daisy chain formation, which meets UL and Rohs compliance standards. Multiple barrel connectors 141 and wires 143 replenish power into lighting modules 140 having a charging socket. The multi-point charging system may be connected to an electrical mains outlet by a 6 volt DC power pack 142. FIG. 42 shows two daisy chain charging systems connected to lighting modules 140, interconnected by a multi-point charger 144 and connected to a 6 volt DC power pack 142 at the input. Additional daisy chain formations may be connected in the same way.

Figure 43:
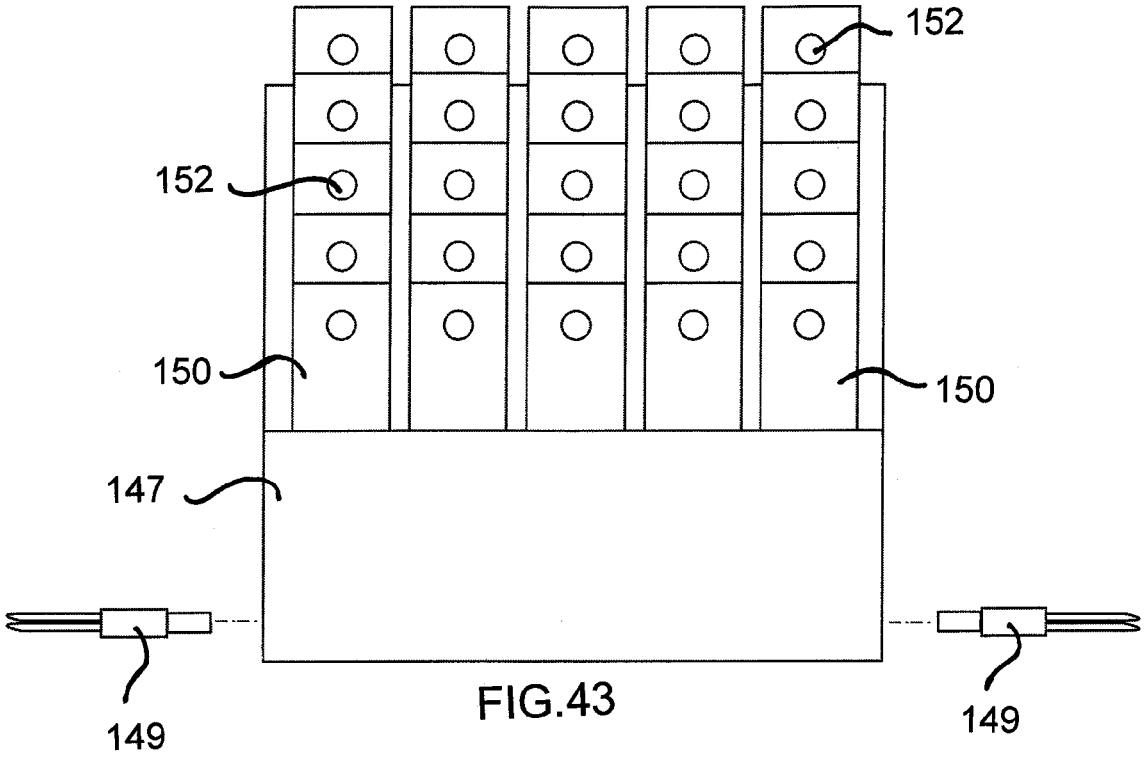
FIGS. 43 and 44 are respective front-elevational and side-elevation views of a multi-module power distribution charging box.
Figure 44:
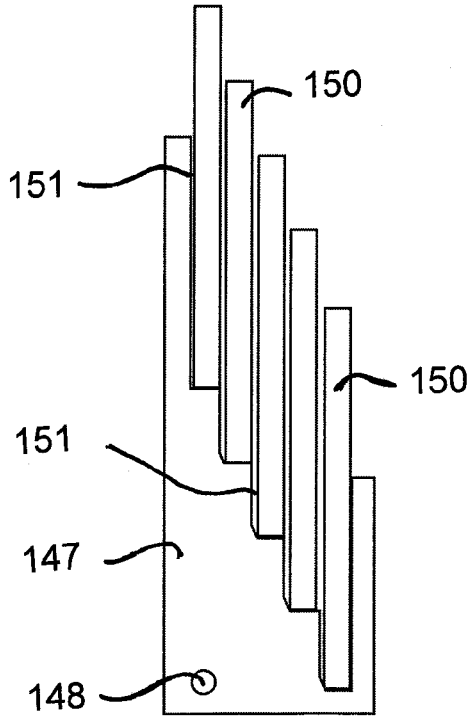
Figure 45:
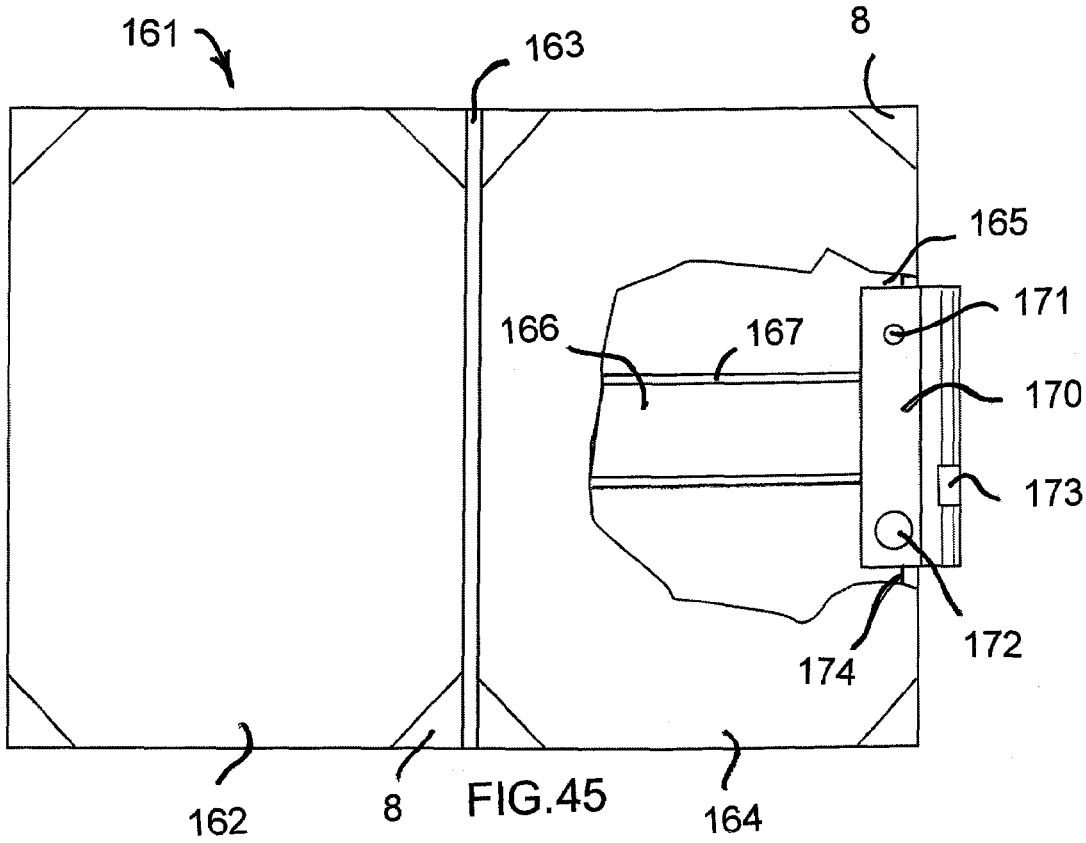
FIG. 45 is a partly broken-away top-plan view of an eighth embodiment of a device according to the invention for illuminating reading material, in the form of a menu cover having the rechargeable lighting module according to FIGS. 30-32 protruding from a cavity and attached by a flexible sliding strap.

FIGS. 43 and 44 are respective front-elevational and side-elevation views of a multi-module power distribution charging box 147 having sockets 148 at each side for insertion of barrel connectors 149 respectively leading to an electrical mains outlet and to another charging box for power distribution. The power distribution box 147, which also meets UL and Rohs compliance standards, is a pre-formed casing containing multiple sets of coordinating gold power conducting contacts multiple cavities 151. The lighting modules 150 are removed from the reading material cover when an LED charge indicator 152 shows a drop in power level, or on a recommended routine basis. The modules 150 are inserted into the box 147 and gold contacts on the base of the lighting modules are aligned with the gold contacts in the distribution box for restoration of power. A 6 volt power pack will be inserted into an electrical mains outlet and connected by a wired barrel connector 149 into the input socket 148 in the box. An output socket will accommodate interconnection to additional boxes 147 to be charged from one electrical mains outlet for the ease of the user. The graduated or stepped configuration seen in the side view of FIG. 44 provides compactness and ease of accessibility. It can be easily mounted onto a wall by way of rear apertures. The compact construction is an advantageous space saving feature, for example for restaurants.

Figure 49:
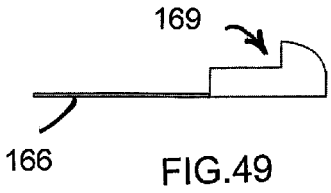
FIGS. 46, 47, 48 and 49 are respective top-plan, left side-elevational, right side-elevational and rear-elevational views of the lighting module according to FIG. 45.
Figure 47:
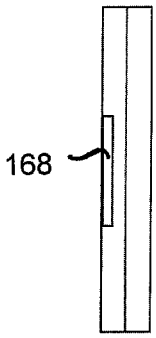
Figure 46:
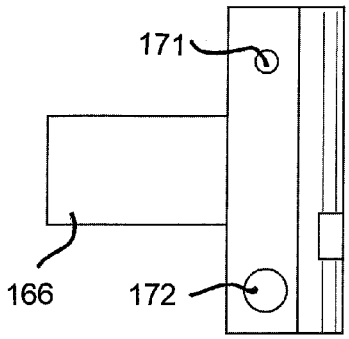
Figure 48:
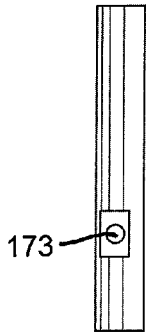
Figure 50:
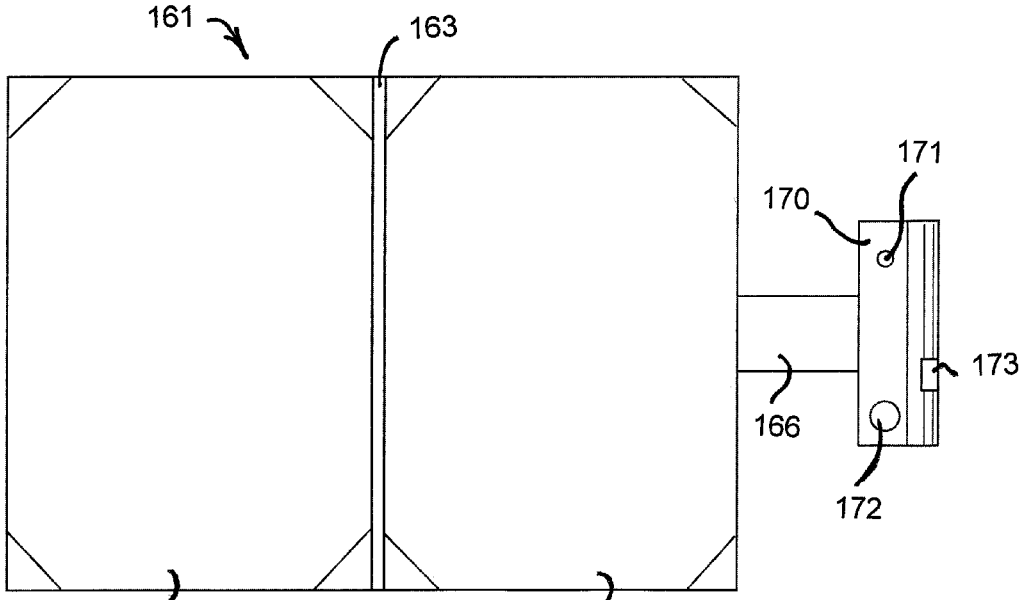
FIG. 50 is a top-plan view of the device according to FIG. 45, with the lighting module extended on the sliding strap.

FIGS. 45-50 illustrate an eighth embodiment of a device in the form of a menu cover 161 having first and second panels 162, 164 interconnected by a living hinge 163. The first and second panels are cover panels each having an effective reading material receiving surface covering substantially all of the surface of the panels between the holders 8. The cover panels completely enclose the reading material in a closed condition and permit reading of the reading material in an open condition. In this embodiment, a rechargeable lighting module 170, which has components similar to those shown in FIGS. 30-32 and which is smaller than the effective reading material receiving surface, protrudes from a cavity 165 in the panel 164 and is attached by a flexible strap 166 sliding in a channel 167. The lighting module 170 has an LED 171, a push button 172 and a charging socket 173. The strap 166 is attached to the encasement of the lighting module 170 at a die cut 168 shown in FIG. 47. The end of the strap 166 in the panel 164 may have a T-shape impacting a stop surface 174 and preventing over extension of the strap. FIG. 49 shows that the encasement has an L-shape forming a step 169 which rests against the outer edge of the panel 164, providing a slim shape while being extended for connection and ease of access and grasping.

Figure 51:
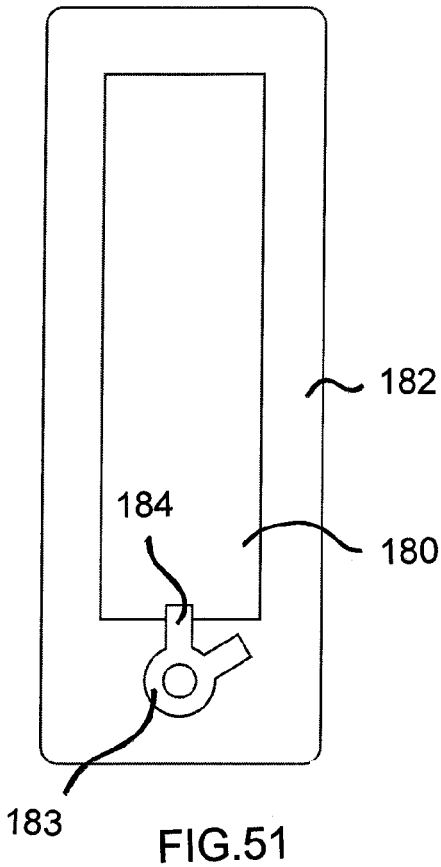
FIGS. 51 and 52 are respective top-plan and side-elevational views of a tray and FIGS. 53 and 54 are respective top-plan and side-elevational views of a lighting module, illustrating various locking mechanisms.
Figure 52:
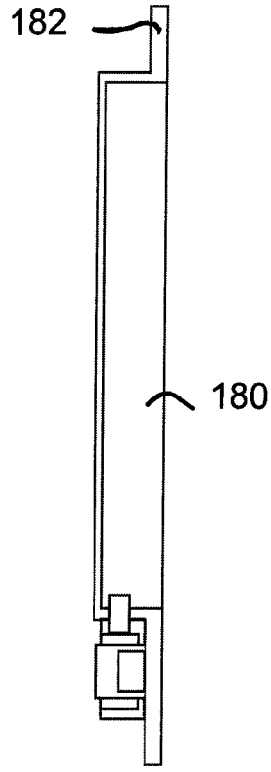

FIGS. 51 and 52 show a tray 182 holding a wireless lighting module 180 with an optional, simple, rotating locking mechanism 183. The tray or holding receptacle adheres to a cover or is encased in a flexible molding of the reading material cover. The locking mechanism 183 is screwed or riveted to the tray and has fingers 184 for holding the module in place.

Figure 53:
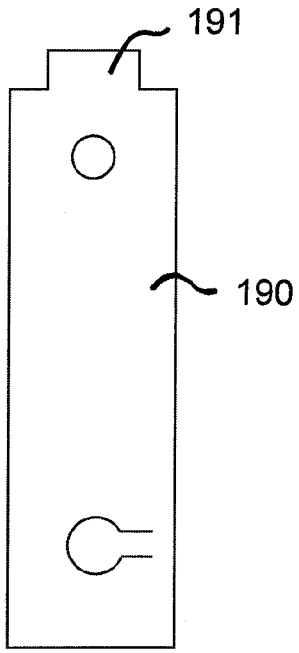
Figure 54:
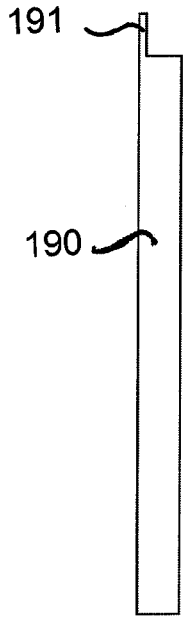
Figure 55:
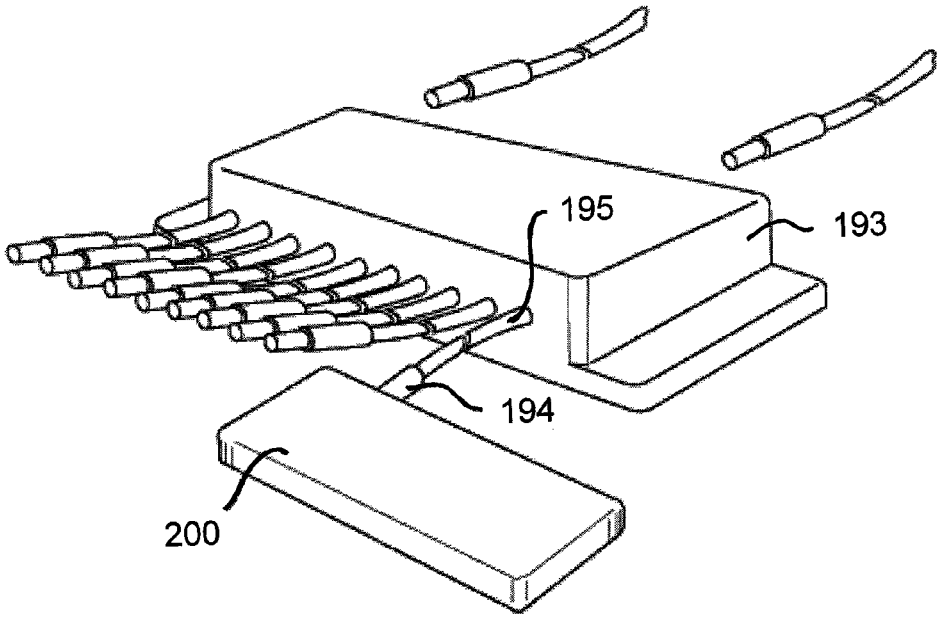
FIGS. 55 and 56 are perspective views and FIGS. 57, 58, 59 and 60 are respective top-plan, rear-elevational, side-elevational and front-elevational views of multi-wired charge distribution boxes.

FIGS. 53 and 54 show a module 190 to be locked into a tray by a tab 191.

Figure 56:
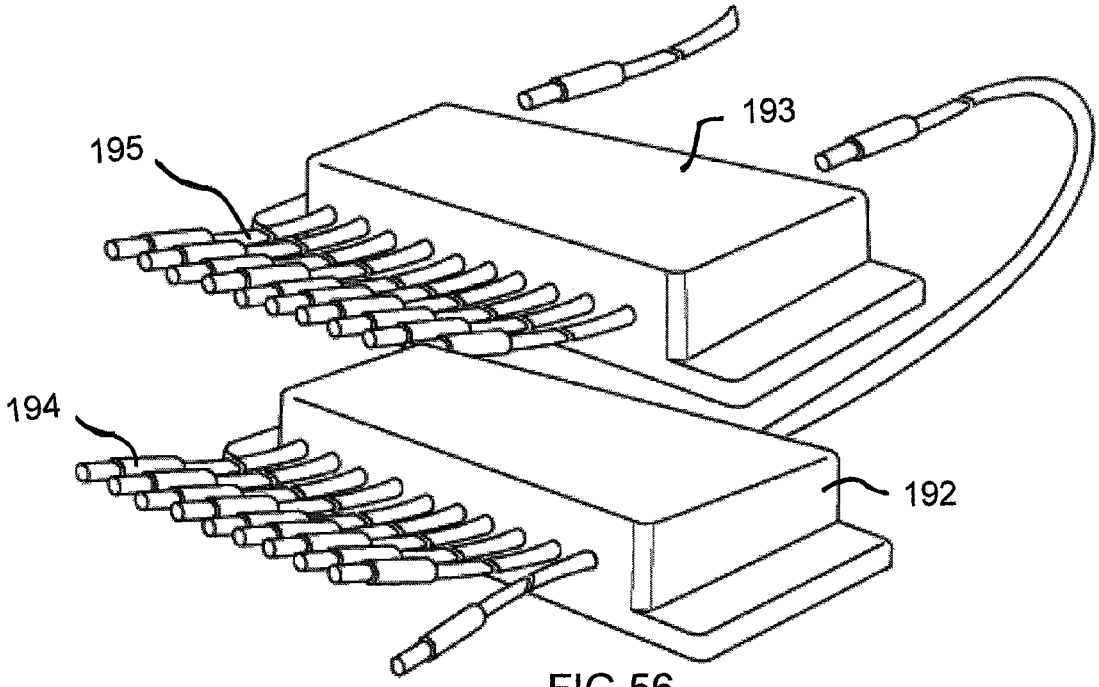
Figure 58:
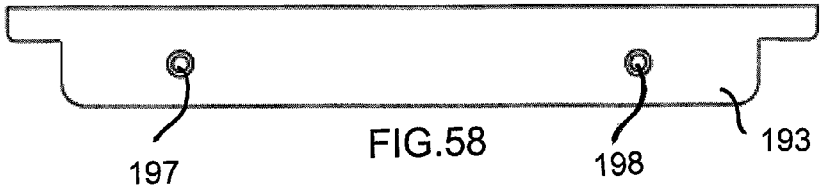
Figure 59:
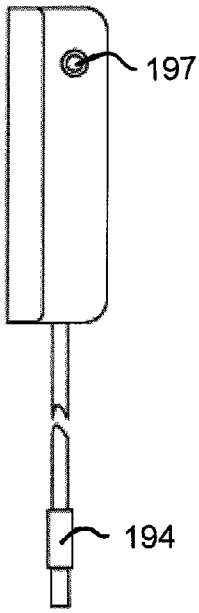
Figure 57:
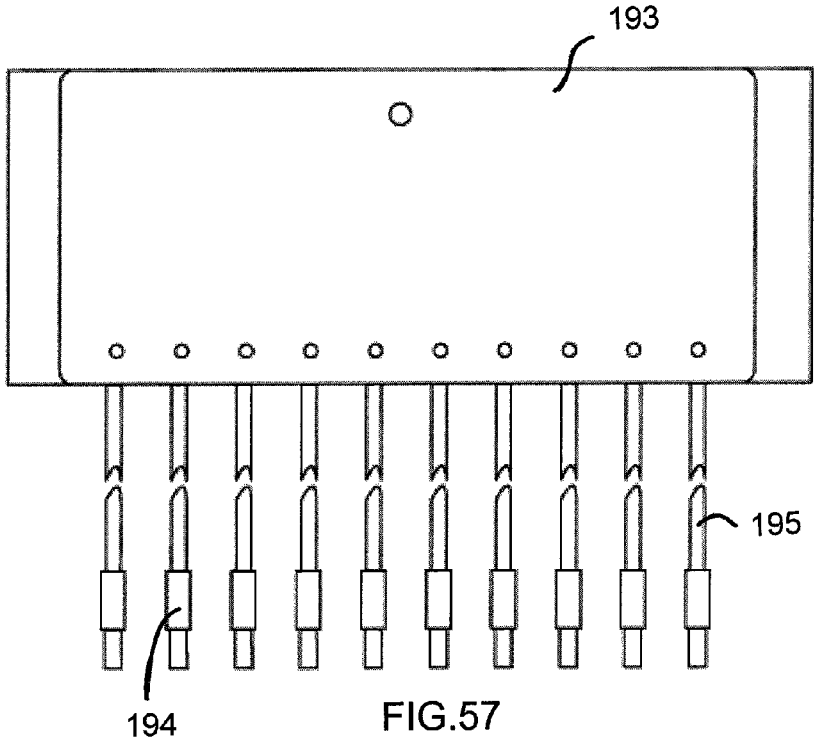
Figure 60:
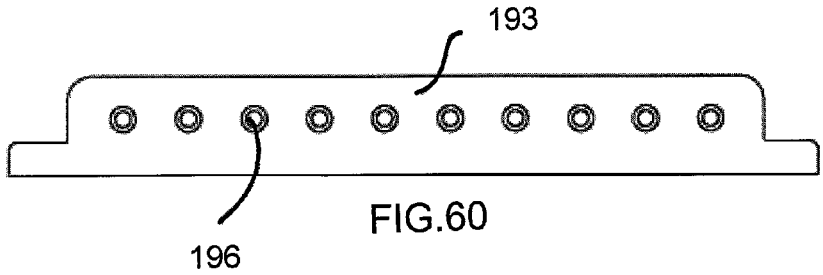

FIGS. 55-60 show multi-wired charge distribution boxes 193 for supplying power to modules 200 by insertion of barrel connectors 194 at ends of wires 195 into charging sockets 196 of the boxes. The wires 195 may be retractable for manageability. FIGS. 58 and 59 show respective additional sockets 197, 198 for connection to an electrical mains outlet or to another distribution box 192 as shown in FIG. 56.

The invention claimed is:

1. A device for illuminating single or multiple page reading material in dimly lit locations, the device comprising:

two hinged-together cover panels each having a holder for the single or multiple page reading material, said cover panels completely enclosing the single or multiple page reading material in a closed condition and permitting reading of the single or multiple page reading material in an open condition;

an additional panel hinged to and folding over one of said cover panels and being sandwiched between said cover panels when not in use; and a lighting module retained to said additional panel for directing light onto the single or multiple page reading material by independently moving said additional panel.

2. The device according to claim 1, wherein said cover panels each have an effective reading material receiving surface, and said additional panel is smaller or narrower than said effective reading material receiving surface of each of said cover panels.

3. The device according to claim 1, wherein said panels are hinged together by living hinges.

4. The device according to claim 1, which further comprises a tray embedded in said additional panel, said lighting module being releasably locked in said tray.

5. The device according to claim 1, wherein said additional panel is hinged to said one of said cover panels at the top or at the side of said effective reading material receiving surface.

6. The device according to claim 1, wherein said lighting module is removably affixed to an outer surface of said additional panel.

7. The device according to claim 1, wherein said lighting module is enclosed within said additional panel, is rechargeable and contains a battery, a push button and an LED, and said additional panel has a charging socket for charging said lighting module.

8. A device for illuminating single or multiple page reading material in dimly lit locations, the device comprising:

two hinged-together cover panels each having a holder for the single or multiple page reading material, said cover panels completely enclosing the single or multiple page reading material in a closed condition and permitting reading of the single or multiple page reading material in an open condition;

an additional panel hinged to one of said cover panels, said additional panel being spring-biased to pop-up at an angle for illuminating the single or multiple page reading material; and a lighting module retained to said additional panel for directing light onto the single or multiple page reading material by independently moving said additional panel.

9. A device for illuminating single or multiple page reading material in dimly lit locations, the device comprising:

at least one panel for holding the single or multiple page reading material;

a lighting module being rechargeable and containing a battery, a push button, an LED and a charging socket, said lighting module being one of a plurality of lighting modules; and a flexible strap connected to said at least one panel and retaining said lighting module for directing light onto the single or multiple page reading material; and a power distribution charging system with a plurality of charging wires or a plurality of cavities in a box, charging said plurality of lighting modules simultaneously.

10. The device according to claim 9, wherein said flexible strap has a tab to be inserted and retained within said at least one panel.

11. A device for illuminating single or multiple page reading material in dimly lit locations, the device comprising:

at least one panel for holding the single or multiple page reading material;

a lighting module being rechargeable and containing a battery, a push button, an LED and a charging socket, said lighting module being one of a plurality of lighting modules;

a lanyard connecting said at least one panel to said lighting module for directing light onto the single or multiple page reading material; and a power distribution charging system with a plurality of charging wires or a plurality of cavities in a box, charging said plurality of lighting modules simultaneously.

12. A device for illuminating single or multiple page reading material in dimly lit locations, the device comprising:

at least one panel for holding the single or multiple page reading material, said at least one panel having a cavity formed therein;

a lighting module to be receiving in said cavity;

a reel enclosed within said at least one panel; and a lanyard having one end wound on said reel and another end connected to said lighting module, for directing light onto the single or multiple page reading material.

13. The device according to claim 12, wherein said lighting module protrudes a sufficient distance from said cavity, with said lanyard retracted, to permit grasping of said lighting module.

14. A device for illuminating single or multiple page reading material in dimly lit locations, the device comprising:

at least one panel for holding the single or multiple page reading material, said at least one panel having a channel formed therein;

a lighting module being rechargeable and containing a battery, a push button, an LED and a charging socket, said lighting module being one of a plurality of lighting modules;

a flexible strap sliding in said channel and retaining said lighting module for directing light onto the single or multiple page reading material; and a power distribution charging system with a plurality of charging wires or a plurality of cavities in a box, charging said plurality of lighting modules simultaneously.

15. The device according to claim 1, wherein said lighting module has a programmable microprocessor.

16. The device according to claim 1, wherein said lighting module is wireless and contains a battery, a push button and an LED.

17. The device according to claim 12, wherein said lighting module is rechargeable and contains a battery, a push button, an LED and a charging socket.

18. The device according to claim 17, wherein said lighting module is one of a plurality of lighting modules, and a power distribution charging system with a plurality of charging wires or a plurality of cavities in a box, charges said plurality of lighting modules simultaneously.

* * * * *